US011918156B2

(12) United States Patent
Yang et al.

(10) Patent No.: US 11,918,156 B2
(45) Date of Patent: Mar. 5, 2024

(54) PUSH-PUMP FOR DISPENSING SOAP OR OTHER LIQUIDS

(71) Applicant: Simplehuman, LLC, Torrance, CA (US)

(72) Inventors: Frank Yang, Rancho Palos Verdes, CA (US); Joseph Sandor, Newport Beach, CA (US); William Patrick Conley, Long Beach, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 17/665,377

(22) Filed: Feb. 4, 2022

(65) Prior Publication Data

US 2022/0248914 A1 Aug. 11, 2022

Related U.S. Application Data

(60) Provisional application No. 63/146,270, filed on Feb. 5, 2021.

(51) Int. Cl.
*A47K 5/12* (2006.01)

(52) U.S. Cl.
CPC ..... *A47K 5/1205* (2013.01); *A47K 5/1211* (2013.01)

(58) Field of Classification Search
CPC ..... A47K 5/1205; A47K 5/1211; B05B 11/3097; B05B 11/3047; B05B 11/0038; B05B 11/0064; B05B 11/3067
See application file for complete search history.

(56) References Cited

U.S. PATENT DOCUMENTS 1,598,970 A * 9/1926 Anton ..... A47K 5/1211 222/320
1,852,821 A * 4/1932 Rambo ..... A47K 5/1205 510/439

(Continued)

FOREIGN PATENT DOCUMENTS

CA 141847 4/2012
CA 144016 4/2012

(Continued)

OTHER PUBLICATIONS

Simplehuman® Sensor Pump Max Liquid Soap or Sanitizer Dispenser, https://www.officedepot.com/a/products/8839133/simplehuman-Sensor-Pump-Max-Liquid-Soap/#Reviews, available Aug. 2021, retrieved Mar. 29, 2022, in 2 pages.

(Continued)

*Primary Examiner* — Donnell A Long
(74) *Attorney, Agent, or Firm* — Knobbe Martens Olson and Bear, LLP

(57) ABSTRACT

Disclosed herein are embodiments of a manually operated liquid dispenser. In any embodiments disclosed herein, the dispenser can include a housing with a volume of space therein, the volume of space having a first end and a second end, a pump sleeve extending into the space of the housing and nearly to a bottom, inside surface of the space, a pump head, a push rod coupled with the pump head and configured to be axially movable within an axial opening extending through the pump sleeve, a passageway extending through at least the pump head and the push rod, the passageway being in fluid communication with the axial opening extending through the pump sleeve and with the volume of space within the housing, and a first valve configured to control a passage of a liquid substance within the volume of space in the housing through a passageway.

29 Claims, 12 Drawing Sheets

(56) References Cited

U.S. PATENT DOCUMENTS 2,017,867 A 10/1935 Nantz
2,106,043 A 1/1938 Urquhart et al.
2,294,236 A * 8/1942 Levernier ..... A47K 5/1205 222/179
2,628,744 A 2/1953 Mowbray
2,651,545 A 9/1953 Shotton
2,697,446 A 12/1954 Harrington
2,772,817 A 12/1956 Jauch
3,023,922 A 3/1962 Arrington et al.
3,149,754 A 9/1964 Kogan et al.
3,159,317 A * 12/1964 Mini ..... A47K 5/1211 222/409
3,220,954 A 11/1965 Malbe
3,531,021 A 9/1970 Bassett
3,631,736 A 1/1972 Saari
3,701,482 A 10/1972 Sachnik
4,046,289 A 9/1977 Teranishi
4,056,050 A 11/1977 Brown
4,113,147 A 9/1978 Frazier et al.
4,202,387 A 5/1980 Upton
4,217,993 A 8/1980 Jess et al.
4,280,638 A 7/1981 Keihm
4,457,455 A 7/1984 Meshberg
4,498,843 A 2/1985 Schneider et al.
4,524,805 A 6/1985 Hoffman
4,693,854 A 9/1987 Yau
4,722,372 A 2/1988 Hoffman et al.
4,801,249 A 1/1989 Kakizawa
4,915,347 A 4/1990 Iqbal et al.
4,921,131 A 5/1990 Binderbauer et al.
4,938,384 A 7/1990 Pilolla
4,946,070 A 8/1990 Albert et al.
4,967,935 A 11/1990 Celest
5,028,328 A 7/1991 Long
5,082,150 A 1/1992 Steiner et al.
D325,771 S 4/1992 Di Maggio
5,105,992 A 4/1992 Fender et al.
5,169,040 A 12/1992 Wiley
5,186,360 A 2/1993 Mease et al.
5,199,118 A 4/1993 Cole et al.
5,255,822 A 10/1993 Mease et al.
5,271,528 A 12/1993 Chien
5,305,916 A 4/1994 Suzuki et al.
5,381,932 A * 1/1995 Humphrey ..... A47G 19/183 222/321.9
5,449,280 A 9/1995 Maki et al.
5,466,131 A 11/1995 Altham et al.
5,472,719 A 12/1995 Favre
5,477,984 A 12/1995 Sayama et al.
5,509,578 A 4/1996 Livingstone
5,632,414 A 5/1997 Merriweather, Jr.
5,732,741 A 3/1998 Shiery
5,771,925 A 6/1998 Lewandowski
5,806,721 A * 9/1998 Tada ..... B05B 11/3001 222/321.9
5,823,390 A 10/1998 Muderlak et al.
5,829,636 A 11/1998 Vuong et al.
5,836,482 A 11/1998 Ophardt et al.
5,855,356 A 1/1999 Fait
5,868,311 A 2/1999 Cretu-petra
5,960,991 A 10/1999 Ophardt
D416,154 S 11/1999 Diehl
5,988,451 A 11/1999 Hanna
6,021,705 A 2/2000 Dijs
6,021,960 A 2/2000 Kehat
6,036,056 A 3/2000 Lee et al.
6,048,183 A 4/2000 Meza
D426,093 S 6/2000 Cayouette
D426,413 S 6/2000 Kreitemier et al.
6,126,290 A 10/2000 Veigel
D433,944 S 11/2000 Bernard
6,142,340 A 11/2000 Watanabe et al.
6,152,327 A 11/2000 Rhine et al.
D438,041 S 2/2001 Huang
6,209,752 B1 4/2001 Mitchell et al.
RE37,173 E 5/2001 Jefferson, Jr. et al.
6,269,735 B1 8/2001 Rolfes
6,279,460 B1 8/2001 Pope
6,279,777 B1 8/2001 Goodin et al.
6,311,868 B1 11/2001 Krietemeier et al.
6,325,604 B1 12/2001 Du
6,375,038 B1 4/2002 Daansen et al.
6,390,329 B1 5/2002 Maddox
6,443,328 B1 9/2002 Fehl et al.
6,444,956 B1 9/2002 Witcher et al.
D471,047 S 3/2003 Gordon et al.
6,557,584 B1 5/2003 Lucas et al.
6,594,105 B1 7/2003 Brittner
D477,956 S 8/2003 Grisdale et al.
6,619,938 B2 9/2003 Woodruff
D483,974 S 12/2003 Reed
D484,573 S 12/2003 Haug et al.
D486,335 S 2/2004 Sonneman
6,698,616 B2 3/2004 Hidle et al.
6,722,265 B2 4/2004 Priley
D490,262 S 5/2004 Graves et al.
6,748,850 B1 6/2004 Kraan
6,777,007 B2 8/2004 Cai
6,805,042 B2 10/2004 Mordini et al.
6,824,369 B2 11/2004 Raymond
D499,295 S 12/2004 Grisdale et al.
6,832,542 B2 12/2004 Hu et al.
6,892,899 B2 5/2005 Minard et al.
6,929,150 B2 8/2005 Muderlak et al.
6,971,549 B2 12/2005 Leifheit et al.
6,988,897 B2 1/2006 Belongia et al.
7,008,073 B2 3/2006 Stuhlmacher
D530,954 S 10/2006 Snell
D531,440 S 11/2006 Lo
D531,441 S 11/2006 Soriano
D531,845 S 11/2006 Christianson
D534,753 S 1/2007 Christianson
7,178,746 B2 2/2007 Gross
7,213,593 B2 5/2007 Hochrainer
D554,412 S 11/2007 Yang et al.
7,296,765 B2 11/2007 Rodrian
D560,942 S 2/2008 Hanna
D564,273 S 3/2008 Yang et al.
7,337,635 B2 3/2008 Cerruti et al.
D565,878 S 4/2008 Krus
7,354,015 B2 4/2008 Byrd et al.
D569,736 S 5/2008 Oates et al.
D581,193 S 11/2008 Ghiorghie
D582,187 S 12/2008 Yang et al.
7,479,000 B2 1/2009 Klassen
D593,784 S 6/2009 Chan
7,540,397 B2 6/2009 Muderlak et al.
D604,544 S 11/2009 Daams
7,637,893 B2 12/2009 Christensen et al.
D608,578 S 1/2010 Yang et al.
D610,917 S 3/2010 Ho
D622,991 S 9/2010 MacDonald et al.
7,815,074 B2 10/2010 Clavarella et al.
D626,365 S 11/2010 Yang et al.
D644,523 S 9/2011 Howell et al.
D644,529 S 9/2011 Padain et al.
D644,530 S 9/2011 Padain et al.
D644,531 S 9/2011 Padain et al.
8,087,543 B2 1/2012 Yang et al.
8,096,445 B2 1/2012 Yang et al.
8,109,301 B1 2/2012 Denise
8,109,411 B2 2/2012 Yang et al.
8,152,027 B1 4/2012 Baker
D658,915 S 5/2012 Fernandes et al.
D659,452 S 5/2012 Yang et al.
D659,454 S 5/2012 Fritz et al.
D660,061 S 5/2012 Fernandes et al.
D661,531 S 6/2012 Tompkin
D661,933 S 6/2012 Delgigante et al.
D663,143 S 7/2012 Delgigante et al.
D663,983 S 7/2012 Yang et al.
D664,387 S 7/2012 Kennedy
D672,177 S 12/2012 Zeng
D674,636 S 1/2013 Yang et al.

(56) References Cited

U.S. PATENT DOCUMENTS

| | | | |
|---|---|---|---|
| 8,360,285 | B2 | 1/2013 | Grbesic |
| D676,116 | S | 2/2013 | Judd |
| D682,589 | S | 5/2013 | Cheng |
| D688,488 | S | 8/2013 | Wang |
| D689,299 | S | 9/2013 | Kassem Llano et al. |
| D690,129 | S | 9/2013 | Clough et al. |
| D690,130 | S | 9/2013 | Clough et al. |
| D690,131 | S | 9/2013 | Clough et al. |
| D690,530 | S | 10/2013 | Clough et al. |
| 8,550,378 | B2 | 10/2013 | Mazooji et al. |
| D693,597 | S | 11/2013 | Yang et al. |
| D699,047 | S | 2/2014 | Lissoni |
| D699,475 | S | 2/2014 | Yang et al. |
| D699,574 | S | 2/2014 | Cox et al. |
| 8,662,356 | B2 | 3/2014 | Padain et al. |
| 8,678,244 | B2 | 3/2014 | Yang et al. |
| D706,549 | S | 6/2014 | Cho |
| 8,740,019 | B1 | 6/2014 | Clavarella et al. |
| D717,066 | S | 11/2014 | Deacon |
| 8,893,928 | B2 | 11/2014 | Proper |
| D721,279 | S | 1/2015 | Van Handel et al. |
| D727,653 | S | 4/2015 | Bjerre-poulsen et al. |
| D731,203 | S | 6/2015 | Watson et al. |
| D731,204 | S | 6/2015 | Watson et al. |
| D732,308 | S | 6/2015 | Enga et al. |
| D733,454 | S | 7/2015 | Von Heifner et al. |
| D746,136 | S | 12/2015 | Liu |
| 9,265,383 | B2 | 2/2016 | Yang et al. |
| 9,375,741 | B2 | 6/2016 | Turner |
| D765,440 | S | 9/2016 | Clough et al. |
| D770,798 | S | 11/2016 | Yang et al. |
| D773,847 | S | 12/2016 | Judd |
| D773,848 | S | 12/2016 | Yang et al. |
| D785,970 | S | 5/2017 | Yang et al. |
| D786,579 | S | 5/2017 | Beck et al. |
| 9,763,546 | B2 | 9/2017 | Yang et al. |
| D815,855 | S | 4/2018 | Bos et al. |
| D818,741 | S | 5/2018 | Yang et al. |
| 10,076,216 | B2 | 9/2018 | Yang et al. |
| D829,465 | S | 10/2018 | Yang et al. |
| D832,414 | S | 10/2018 | Sharma et al. |
| 10,150,127 | B2 | 12/2018 | Tepas et al. |
| D842,121 | S | 3/2019 | Lee |
| D854,134 | S | 7/2019 | Jessup |
| D876,955 | S | 3/2020 | Atalay |
| 10,588,467 | B2 | 3/2020 | Yang et al. |
| D881,367 | S | 4/2020 | Kihm et al. |
| D882,056 | S | 4/2020 | Baillie et al. |
| D884,480 | S | 5/2020 | Karekar |
| D897,721 | S | 10/2020 | Jia |
| 10,806,305 | B2 | 10/2020 | Yang et al. |
| D906,723 | S | 1/2021 | Chen |
| D916,262 | S | 4/2021 | Wang et al. |
| D916,499 | S | 4/2021 | Chen |
| 11,064,846 | B2 | 7/2021 | Yang et al. |
| 11,141,026 | B2 | 10/2021 | Yang et al. |
| D936,196 | S | 11/2021 | Xu |
| D962,672 | S | 9/2022 | Yang et al. |
| D967,650 | S | 10/2022 | Yang et al. |
| 2002/0179643 | A1 | 12/2002 | Knight et al. |
| 2002/0185002 | A1 | 12/2002 | Herrmann |
| 2003/0068242 | A1 | 4/2003 | Yamakawa |
| 2004/0032749 | A1 | 2/2004 | Schindler et al. |
| 2004/0050875 | A1 | 3/2004 | Kobayashi |
| 2004/0077187 | A1 | 4/2004 | Belongia et al. |
| 2004/0103792 | A1 | 6/2004 | Cirigliano et al. |
| 2004/0134924 | A1 | 7/2004 | Hansen et al. |
| 2004/0226962 | A1 | 11/2004 | Mazursky et al. |
| 2005/0006407 | A1 | 1/2005 | Lawson et al. |
| 2005/0127099 | A1 | 6/2005 | Chou |
| 2005/0139612 | A1 | 6/2005 | Matthews et al. |
| 2005/0279783 | A1 | 12/2005 | Lo |
| 2006/0067546 | A1 | 3/2006 | Lewis et al. |
| 2006/0086760 | A1* | 4/2006 | Cohen ..... B05B 11/3059 222/321.9 |
| 2006/0173576 | A1 | 8/2006 | Goerg et al. |
| 2006/0243740 | A1 | 11/2006 | Reynolds et al. |
| 2007/0000941 | A1 | 1/2007 | Hadden et al. |
| 2007/0138202 | A1 | 6/2007 | Evers |
| 2007/0138208 | A1 | 6/2007 | Scholz et al. |
| 2007/0158359 | A1 | 7/2007 | Rodrian |
| 2007/0274853 | A1 | 11/2007 | Merendeiro et al. |
| 2008/0149669 | A1 | 6/2008 | Nicholson et al. |
| 2008/0277411 | A1 | 11/2008 | Beland et al. |
| 2008/0277421 | A1 | 11/2008 | Zlatic et al. |
| 2008/0283556 | A1 | 11/2008 | Snodgrass |
| 2009/0026225 | A1 | 1/2009 | Lickstein |
| 2009/0088836 | A1 | 4/2009 | Bishop et al. |
| 2009/0140004 | A1 | 6/2009 | Scorgie |
| 2009/0184134 | A1 | 7/2009 | Ciavarella et al. |
| 2009/0200340 | A1 | 8/2009 | Ophardt et al. |
| 2010/0031982 | A1 | 2/2010 | Hornsby et al. |
| 2010/0051642 | A1 | 3/2010 | Wong et al. |
| 2010/0282772 | A1 | 11/2010 | Ionidis |
| 2010/0320227 | A1 | 12/2010 | Reynolds |
| 2011/0017769 | A1 | 1/2011 | Ophardt |
| 2011/0114669 | A1 | 5/2011 | Yang et al. |
| 2011/0253744 | A1 | 10/2011 | Pelfrey |
| 2011/0272432 | A1 | 11/2011 | Baughman |
| 2011/0303695 | A1 | 12/2011 | Fern |
| 2012/0097711 | A1 | 4/2012 | Xianzhi et al. |
| 2012/0111895 | A1 | 5/2012 | Fitzpatrick et al. |
| 2012/0138632 | A1 | 6/2012 | Li et al. |
| 2012/0138637 | A1 | 6/2012 | Ciavarella et al. |
| 2012/0248149 | A1 | 10/2012 | Pelfrey et al. |
| 2012/0285992 | A1 | 11/2012 | Ciavarella et al. |
| 2012/0318820 | A1 | 12/2012 | Amsel et al. |
| 2013/0119083 | A1 | 5/2013 | Ophardt et al. |
| 2013/0140323 | A1 | 6/2013 | Yun et al. |
| 2013/0200097 | A1 | 8/2013 | Yang et al. |
| 2013/0200109 | A1 | 8/2013 | Yang et al. |
| 2013/0214011 | A1 | 8/2013 | Vandekerchkhove et al. |
| 2014/0103072 | A1 | 4/2014 | Pelfrey |
| 2014/0137982 | A1 | 5/2014 | Nicholls et al. |
| 2014/0231450 | A1 | 8/2014 | Rosko et al. |
| 2015/0265106 | A1 | 9/2015 | Rospierski |
| 2017/0015541 | A1 | 1/2017 | Vulpitta et al. |
| 2017/0113237 | A1* | 4/2017 | Scott ..... B05B 11/0044 |
| 2021/0378459 | A1 | 12/2021 | Yang et al. |
| 2022/0133095 | A1 | 5/2022 | Yang et al. |
| 2022/0248915 | A1 | 8/2022 | Yang et al. |

FOREIGN PATENT DOCUMENTS

| | | | |
|---|---|---|---|
| CN | 1285899 | A | 2/2001 |
| CN | 101606828 | A | 12/2009 |
| CN | 102058336 | A | 5/2011 |
| CN | 306917043 | | 11/2021 |
| DE | 3718967 | A1 | 12/1987 |
| DE | 3718967 | C2 | 5/1994 |
| DE | 19927230 | A1 | 12/2000 |
| EP | 0455431 | A1 | 11/1991 |
| EP | 0493865 | A1 | 7/1992 |
| EP | 2135538 | A1 | 12/2009 |
| EP | 2322068 | A2 | 5/2011 |
| EP | 2546523 | A2 | 1/2013 |
| EP | 2738387 | A1 | 6/2014 |
| EP | 008517734-0001 | | 4/2021 |
| GB | 9004350817-0001 | | 9/2017 |
| JP | H07-23876 | | 1/1995 |
| JP | D1117308 | | 6/2001 |
| JP | 2002-130153 | A | 5/2002 |
| JP | D1266683 | | 2/2006 |
| JP | 2013-133754 | A | 7/2013 |
| KR | 3002845520000 | | 11/2001 |
| WO | WO 2008/095187 | | 8/2008 |
| WO | WO 2008/103300 | A2 | 8/2008 |
| WO | WO 2012/122056 | | 9/2012 |
| WO | WO 2012/154642 | A1 | 11/2012 |

(56) References Cited

FOREIGN PATENT DOCUMENTS

| | | | |
|---|---|---|---|
| WO | WO 2013/119642 | A1 | 8/2013 |
| WO | WO 2013/119874 | A1 | 8/2013 |

OTHER PUBLICATIONS

Simplehuman Pulse Pump Brushed Stainless Steel 10 oz. Capacity Freestanding Soap and Lotion Dispenser, available in lowes.com, customer review oldest date Mar. 24, 2021, retrieved on Mar. 24, 2022, https://www.lowes.com/pd/simplehuman-simplehuman-10-oz-Pulse-Pump-Brushed-Stainless, in 7 pages.
Extended Search Report in corresponding European Patent Application No. 22155297.9, dated Jun. 10, 2022, in 9 pages.
U.S. Appl. No. 29/756,158, filed Aug. 26, 2020, Yang et al.
U.S. Appl. No. 29/747,947, filed Aug. 26, 2020, Yang et al.
U.S. Appl. No. 17/666,377, filed Feb. 7, 2022, Yang et al.
Manring et al., "The Theoretical Flow Ripple of an External Gear Pump," Transactions of the ASME, vol. 125, Sep. 2003, pp. 396-404.
The Sharper Image Soap Genie SI335, Mar. 2006, in 8 pages.
Simplehuman® Rechargeable Sensor Soap Dispenser, Item No. 201881, https://www.sharperimage.com/si/view/product/Rechargeable-Sensor-Soap-Dispenser/201881?trail, published on Sep. 3, 2013, in 3 pages.
Simplehuman Push Pump with Caddy image, 2016.
Mechanics drawing of a generic pump, publication date of 2019.

* cited by examiner

PUSH-PUMP FOR DISPENSING SOAP OR OTHER LIQUIDS

INCORPORATION BY REFERENCE TO ANY PRIORITY APPLICATIONS

The present application claims the benefit under 35 U.S.C. § 119(e) to U.S. Patent Application No. 63/146,270, filed on Feb. 5, 2021. The contents of each of these priority applications are hereby incorporated by reference herein in their entirety as if fully set forth herein for all purposes. Any and all applications for which a foreign or domestic priority claim is identified in the Application Data Sheet as filed with the present application are hereby incorporated by reference herein in their entirety and made a part of this specification.

BACKGROUND OF THE DISCLOSURE

Field of the Disclosure

This disclosure relates to manually operated liquid dispensers including, without limitation, manually operated liquid soap dispensers.

SUMMARY OF SOME EXEMPLIFYING EMBODIMENTS

The systems, methods and devices of this disclosure each have several innovative aspects, implementations, or aspects, no single one of which is solely responsible for the desirable attributes disclosed herein.

Disclosed herein are embodiments of a manually operated liquid dispenser. In any embodiments disclosed herein, the dispenser can include a housing with a volume of space therein, the volume of space having a first end and a second end, a pump sleeve extending into the space of the housing and nearly to a bottom, inside surface of the space, a pump head, a push rod coupled with the pump head and configured to be axially movable within an axial opening extending through the pump sleeve, a passageway extending through at least the pump head and the push rod, the passageway being in fluid communication with the axial opening extending through the pump sleeve and with the volume of space within the housing, and a first valve configured to control a passage of a liquid substance within the volume of space in the housing through a passageway.

Any embodiments of the manually operated dispenser or methods of using same disclosed herein can include, in additional embodiments, one or more of the following steps, features, components, and/or details, in any combination with any of the other steps, features, components, and/or details of any other embodiments disclosed herein: wherein the dispenser does not have a dip tube; wherein the dispenser can be configured to fully depress and dispense a liquid substance with 1 kg or less of force applied to the pump head; wherein the pump sleeve extends toward the second end of the volume of space such that a distance between a distal end of the pump sleeve and the second end of the volume of space can be less than approximately 5% of the distance from the first end of the volume of space of the housing to the second end of the volume of space of the housing; wherein the pump sleeve extends toward the second end of the volume of space such that a distance between a distal end of the pump sleeve and the second end of the volume of space can be less than or equal to the average diameter or cross-sectional width of a majority of a length of the pump sleeve; comprising a spring configured to axially bias the push rod toward the pump head; wherein the first valve can be configured to close or inhibit a flow of liquid through the first valve when the pump head is depressed; comprising a second valve configured to control a passage of a liquid substance within the passageway through a passageway in the pump head; wherein the first valve can be positioned at a distal end of the pump sleeve and the second valve can be positioned at a proximal end of the pump sleeve; and/or wherein the second valve can be configured to prevent a passage of air past the second valve when the pump head is returning from a depressed position to an undepressed position.

Also disclosed herein are embodiments of a manually operated liquid dispenser that can include a housing with a volume of space therein, the volume of space having a first end and a second end, a pump sleeve extending into the space of the housing, a pump head, a push rod coupled with the pump head and configured to be axially movable within an axial opening extending through the pump sleeve, a passageway extending through at least the pump head and the push rod, the passageway being in fluid communication with the axial opening extending through the pump sleeve and with the volume of space within the housing, a first valve configured to control a passage of a liquid substance within the volume of space in the housing through a passageway, and a second valve configured to control a passage of a liquid substance within the volume of space in the housing through a passageway. In some embodiments, the first valve can be positioned at a distal end of the pump sleeve and the second valve can be positioned at a proximal end of the pump sleeve.

Any embodiments of the manually operated dispenser or methods of using same disclosed herein can include, in additional embodiments, one or more of the following steps, features, components, and/or details, in any combination with any of the other steps, features, components, and/or details of any other embodiments disclosed herein: wherein the first valve can be configured to close or inhibit a flow of liquid through the first valve when the pump head is depressed; wherein the first valve can be positioned at a distal end of the pump sleeve and the second valve can be positioned at a proximal end of the pump sleeve; and/or wherein the second valve can be configured to prevent a passage of air past the second valve when the pump head is returning from a depressed position to an undepressed position.

Also disclosed herein are embodiments of a manually operated liquid dispenser that can include a housing with a liquid reservoir configured to contain liquid, the liquid reservoir comprising a top and a bottom, and an upper half and a lower half, a pump sleeve extending into the liquid reservoir of the housing such that the distance between a distal end of the pump sleeve and the bottom of the reservoir can be less than or equal to about the average diameter or cross-sectional width of a majority of the length of the pump sleeve, the pump sleeve having an inner diameter or cross-sectional width, a pump head, a push rod coupled with the pump head and configured to be axially movable within an axial opening extending through the pump sleeve, the push rod comprising a distal end with an outer diameter or cross-sectional width that can be about the same size as the inner diameter or cross-sectional width of the pump sleeve, and a passageway extending through at least the pump head and the push rod, the passageway being in fluid communication with the axial opening extending through the pump sleeve and with the volume of space within the housing. In some embodiments, in the fully actuated position, the distal end of the push rod can extend into the lower half of the liquid reservoir.

Also disclosed herein are embodiments of a method of dispensing a liquid from a manually operated liquid dispenser that can include exerting a force of less than 2 kg on a pump head to depress the pump head to dispense a liquid from the dispenser. Also disclosed herein are embodiments of a device configured to dispense a controlled amount of a liquid soap substantially as hereinbefore described or shown in the accompanying drawings, embodiments of a device configured to dispense a liquidus product substantially as hereinbefore described or shown in the accompanying drawings, embodiments of a method of dispensing a liquidus product substantially as hereinbefore described or shown in the accompanying drawings, and embodiments of a method of dispensing a controlled amount of a liquid soap substantially as hereinbefore described or shown in the accompanying drawings.

DETAILED DESCRIPTION OF THE PREFERRED EMBODIMENT

Figure 1:
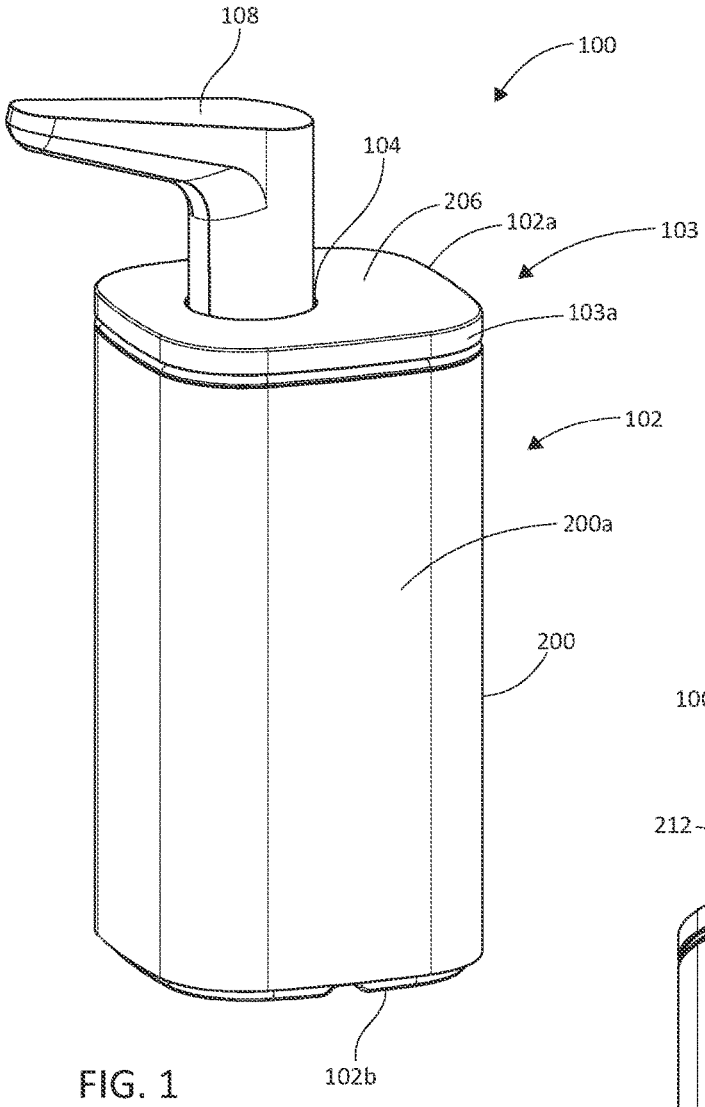
FIG. 1 is a first perspective view of an embodiment of a liquid substance dispenser before actuation of the dispenser by pushing downward on the dispenser.

Disclosed herein are embodiments of an improved liquid substance dispenser 100. Any of the dispenser embodiments disclosed herein can be configured to dispense any suitable liquid or viscous substance 101, including for example and without limitation, soap, lotion, detergent, shampoo, conditioner, and other hair care products, oil, food products such as but not limited to condiments and sauces, and any other similar or desired liquid and/or viscous substances or any combinations thereof. Therefore, as used herein, the terms liquid and/or liquid substance are meant to include and refer to any aforementioned or desired liquid or viscous substances or any combinations thereof.

Some embodiments of the improved liquid dispenser disclosed herein have significant improvements over conventional manually operated soap and/or liquid dispensers. For example and without limitation, by virtue of the improvements to the components of the liquid dispensers disclosed herein, some embodiments of the liquid dispensers are configured to substantially reduce the amount of force needed to actuate the dispenser to dispense the liquid substance as compared to conventional manually operated soap and/or liquid dispensers—e.g., some embodiments of the liquid dispensers are configured to substantially reduce the amount of force needed to depress a pump head component of the dispenser to dispense the liquid substance.

For example, and without limitation, some conventional dispensers dispensing a first liquid substance typically require approximately 2.5 kg of downward force to depress a pump head component of the dispenser or to dispense the liquid substance within the dispenser. In some embodiments of the dispensers disclosed herein, the dispenser can be configured so that less than or equal to about 1 kg of downward force, or approximately 1 kg of force, or 0.7 kg of force (or approximately 0.7 kg of force), or 0.8 kg of force (or approximately 0.8 kg of force), or from 0.7 kg of force (or approximately 0.7 kg of force) to 1 kg of force (or approximately 1 kg of force, or from 0.8 kg of force (or approximately 0.8 kg of force) to 1 kg of force (or approximately 1 kg) of force is required to depress a pump head component of the dispenser having a liquid substance therein or to dispense the same quantity of the first liquid substance within the dispenser, wherein the liquid substance in the improved dispenser is the same as or has approximately the same viscosity as the liquid substance in the conventional dispenser requiring approximately 2.5 kg of downward force.

Without limitation, some embodiments of the dispensers disclosed herein can be configured such that an actuation force of the dispenser (e.g., the downward force required to fully depress the pump head component of the dispenser or to dispense the same quantity of the liquid substance within the dispenser) is approximately 68%-72% lower than the actuation force required to fully depress the pump head component of a conventional dispenser or to dispense the same quantity of the liquid substance within the dispenser, or from 30% (or approximately 30%, or less than 30%) to 70% (or approximately 70%, or at least 70%) lower than the actuation force required to fully depress the pump head component of a conventional dispenser or to dispense the same quantity of the liquid substance within the dispenser, or from 50% (or approximately 50%) to 70% (or approximately 70%, or at least 70%) lower than the actuation force required to fully depress the pump head component of a conventional dispenser or to dispense the same quantity of the liquid substance within the dispenser, or from 50% (or approximately 50%) to 60% (or approximately 60%, or at least 60%) lower than the actuation force required to fully depress the pump head component of a conventional dispenser or to dispense the same quantity of the liquid substance within the dispenser, or of any values within any of the foregoing ranges, or from and to any values within any of the foregoing ranges.

Some embodiments of the improved soap or liquid dispenser disclosed herein can include a housing or container body 102, a top cover 103, an opening 104 through the top cover 103 at a first end 102*a* of the housing 102 and a volume or space 106 (also referred to herein as a volume of space) within the housing 102, a pump head 108 having a passageway 109 therethrough, a push rod 110 that can have a passageway 111 axially extending therethrough that can be in fluid communication with the passageway 109, and a pump sleeve 112 that can extend toward a second end 102*b* of the housing 102. The space 106 can have a first end portion 106*a* and a second end portion 106*b* that is distal to, or further away from the pump head 108 than the first end portion 106*a*. Though not required, some embodiments of the push rod 110 can include a first push rod portion 114 and a second push rod portion 116 coupled with and axially aligned with the first push rod portion 114—which can be for manufacturing reasons. The first push rod portion 114 can have a first end portion 114*a* and a second end portion 114*b*, and the second push rod portion 116 can have a first end portion 116*a* and a second end portion 116*b*. In some embodiments, the second end portion 114*b* can be coupled with the first end portion 116*a*. In other embodiments, the push rod 110 can be made from a single, integral piece.

The second push rod portion 116 can have one or more annular protrusions at the second end portion 116*b*. The annular protrusions at the second end portion 116*b* of the second push rod portion 116 can be configured to engage with an inner wall surface 112*c* of the pump sleeve 112 to ensure radial alignment of the second end portion 116*b* of the second push rod portion 116 within the passageway 118 extending axially through the pump sleeve 112, and/or to provide a seal to prevent or inhibit the liquid substance 101 from advancing within the passageway 118 proximal to the second end portion 116*b* of the second push rod portion 116. In some embodiments, the pump head 108 can be in fluid communication with at least the passageway 111, the passageway 109, and the space 106.

In some embodiments, the push rod 110 can be coupled with the pump head 108 and be configured to slide within an inner space 118 of the pump sleeve 112. Therefore, in some embodiments, the passageway 118 of the pump sleeve 112 can have a larger size or diameter than an outer size or diameter of at least the second push rod portion 116. In some embodiments, the size or outside diameter of the annular protrusions at the second end portion 116*b* of the second push rod portion 116 can be about the same as or slightly larger than an inside size or diameter of the inner space 118 of the pump sleeve 112 to provide an interference fit between the annular protrusions at the second end portion 116*b* of the second push rod portion 116 and the inner wall surface of the inner space 118 of the pump sleeve 112.

In some embodiments, in an operative position, e.g., on a table, countertop, or on another surface that supports the liquid substance dispenser 100 in a generally vertical or upright orientation, the first end 102*a* of the housing 102 can be an upper end of the housing 102 or the end that is further away from the support surface, and the second end 102*b* can be a lower end of the housing 102 or the end that is closer to the support surface, opposite to the upper end of the housing 102. The second end 102*b* can be configured to support the liquid substance dispenser 100 in a generally vertical or upright orientation when the liquid substance dispenser 100 is at rest on a table, countertop, or other generally horizontal surface.

A spring or other axially resilient component or element 130 (referred to hereinafter as the spring) having a first end portion 130*a* and a second end portion 130*b*, such as a compressible elastomeric component (that can be axially hollow or otherwise have openings therein that the liquid substance can pass through) can be positioned axially within the passageway 118. The liquid substance dispenser 100 can be configured such that the second end portion 116*b* contacts or is engaged with a first end portion 130*a* of the spring 130. In this configuration, when the second push rod portion 116 is moved axially toward the second end portion 106*b* of the space 106, such as by depressing the pump head 108, the second end portion 116*b* can contact the first end portion 130*a* and cause the first end portion 130*a* to move toward the second end portion 106*b* of the space 106, thereby causing the spring 130 to compress. As the push rod 110 and/or the pump head 108 are relaxed, the liquid substance dispenser 100 can be configured such that the push rod 110 and the pump head 108 are biased to move away from the second end 102*b*, for example and without limitation by the resilient tensile force of the spring 130. In some embodiments, the pump sleeve 112 can have or support a flange or ledge 131 that can support and/or prevent an axial movement of the second end portion 130*b* of the spring 130. The ledge 131 can have one or more openings therein to permit a passage of the liquid substance 101 therethrough.

Further, in some embodiments, the second end portion 116*b* of the second push rod portion 116 can have one or more recesses or walls 117 formed therein or coupled therewith, configured to receive and at least partially surround the first end portion 130*a* of the spring 130 to limit a movement of a first end portion 130*a* of the spring 130 in the axial direction. In some embodiments, the second end portion 116*b* of the second push rod portion 116 can have one or more flanges or ledges 119 formed therein, configured to provide an axial support surface for the first end portion 130*a* of the spring 130. In some embodiments, the spring 130 can have a tapering diameter along a length thereof, or can otherwise be configured such that the first end portion 130*a* of the spring 130 has a smaller radial size or diameter as compared to the second end portion 130*b* of the spring 130.

Figure 8:
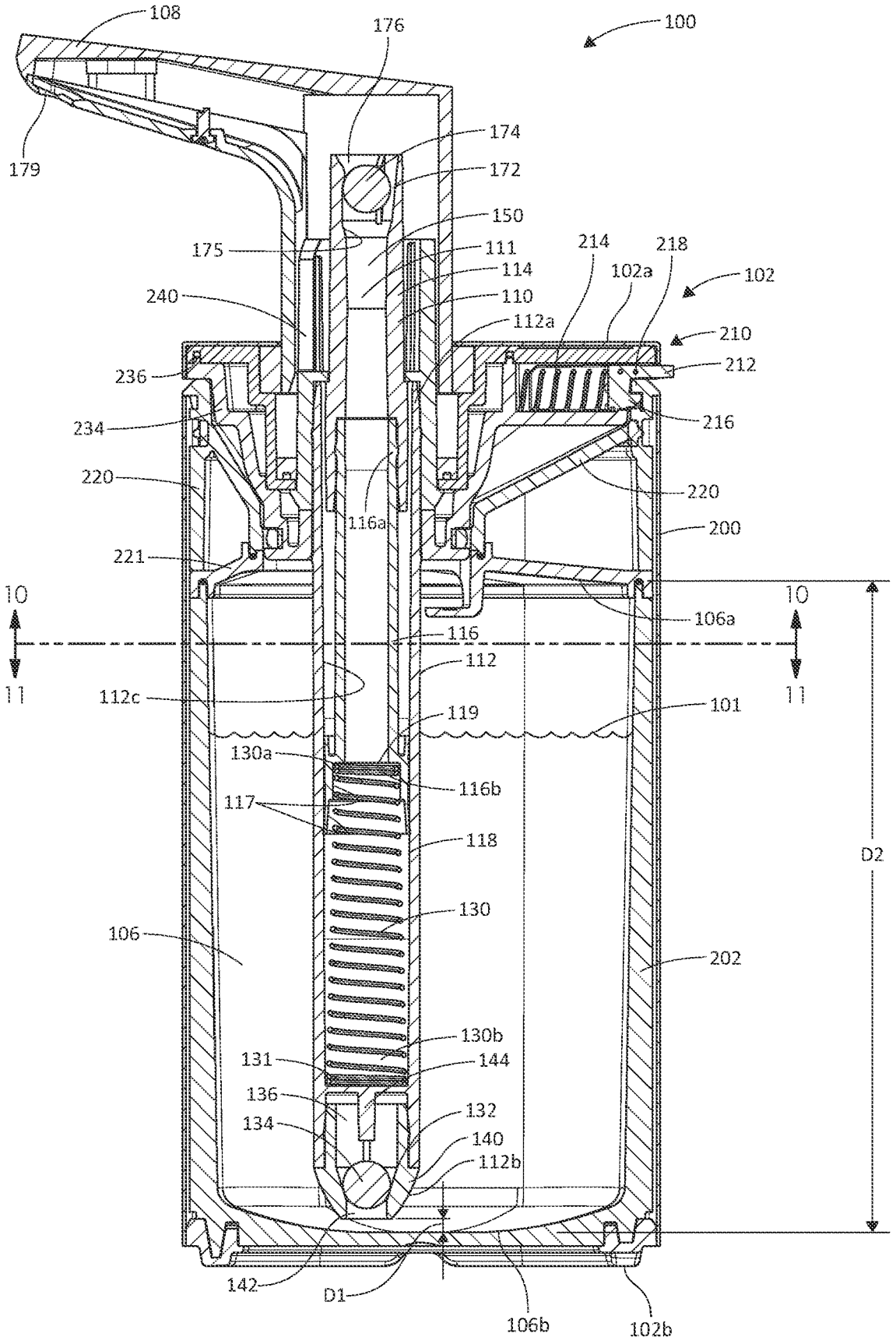
FIG. 8 is a section view of the embodiment of the liquid substance dispenser shown in FIG. 1, taken through line 8-8 in FIG. 6.

The space 106 can have a first end 106*a* and a second end 106*b*. With reference to FIG. 8, which shows internal components of the dispenser before it is actuated by pushing downward on the push rod 110, in some embodiments the space 106 can have a downwardly curved or downwardly angled surface at the second end portion 106*b* of the space 106 so that a depth of the space 106 is greater in a central portion of the second end portion 106*b* of the space 106 than at a peripheral portion of the second end portion 106*b* of the space 106. The pump sleeve 112 can have a first end or proximal end 112*a* and a second end or distal end 112*b*. In some embodiments, the liquid substance dispenser 100 can be configured such that the distal end 112*b* can be positioned within the central portion of the second end portion 106*b* of the space 106 where the depth of the space 106 is increased.

This can increase the amount of the liquid substance 101 that can be dispensed from the space 106.

Figure 9:
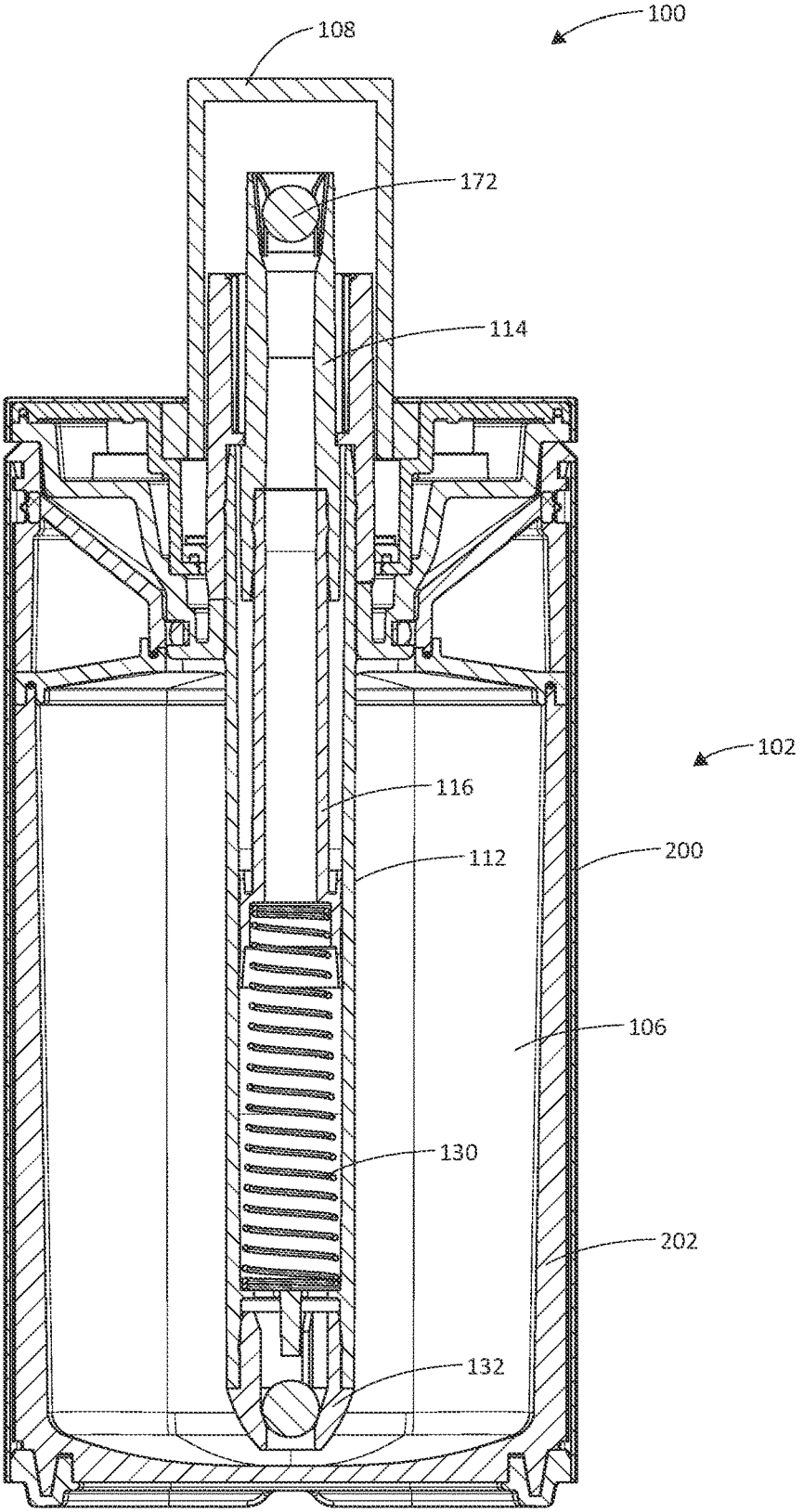
FIG. 9 is a section view of the embodiment of the liquid substance dispenser shown in FIG. 1, taken through line 9-9 in FIG. 6.
Figure 10:
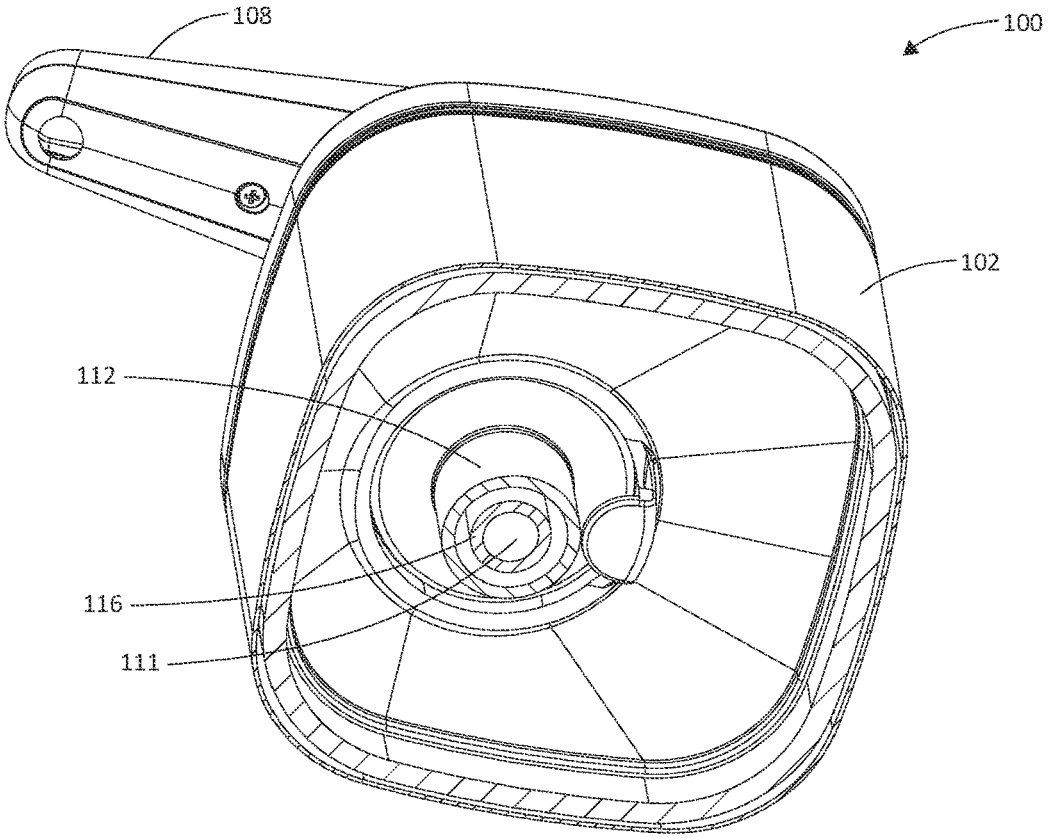
FIG. 10 is a section view of the embodiment of the liquid substance dispenser shown in FIG. 1, taken through line 10-10 in FIG. 8.
Figure 11:
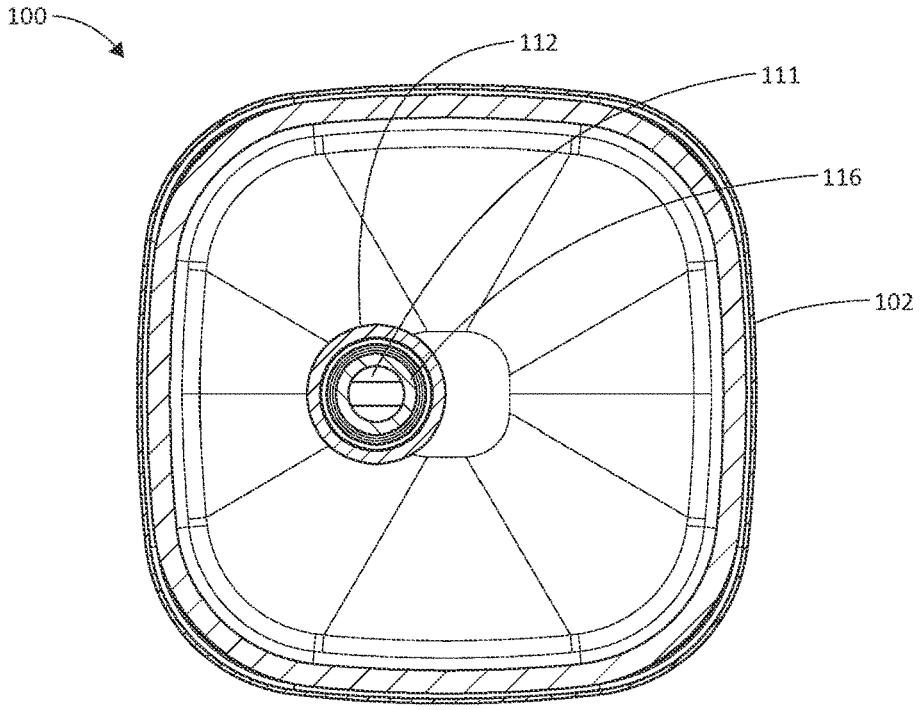
FIG. 11 is a section view of the embodiment of the liquid substance dispenser shown in FIG. 1, taken through line 11-11 in FIG. 8.
Figure 12:
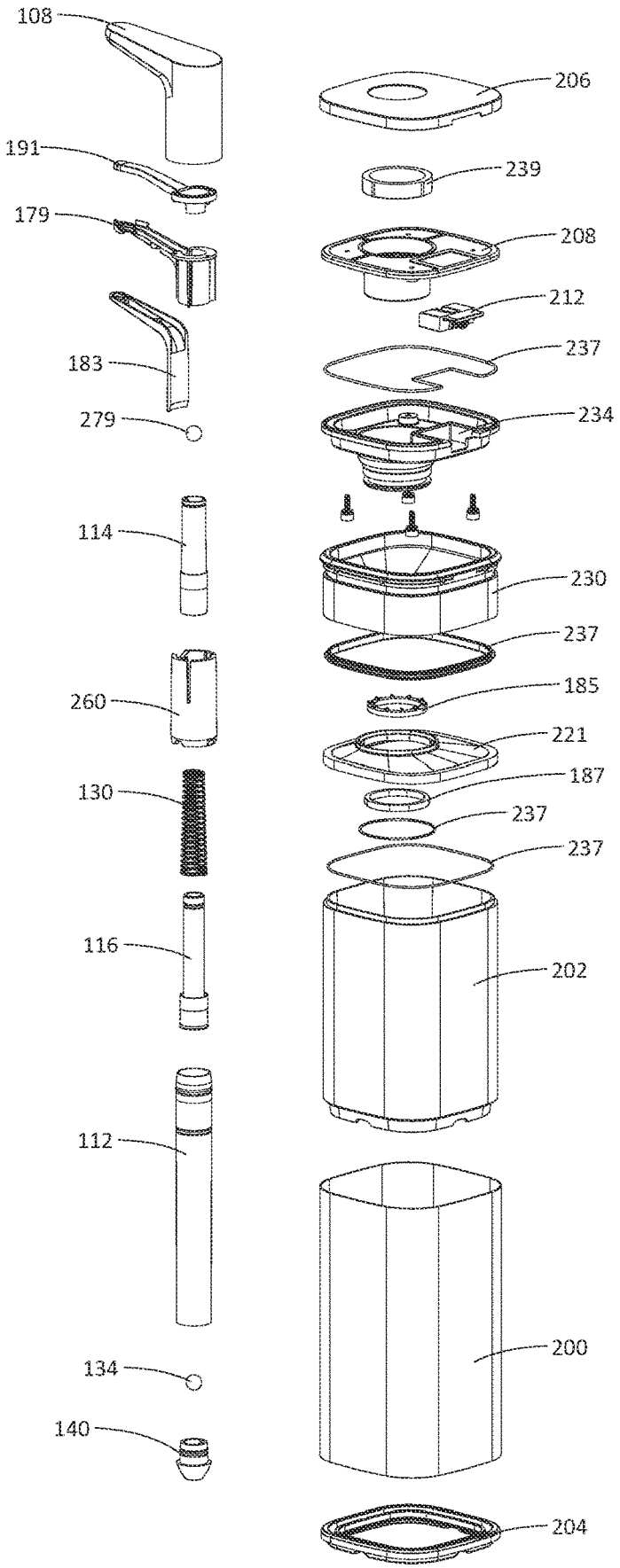
FIG. 12 is a first exploded view of the embodiment of the liquid substance dispenser shown in FIG. 1.
Figure 13:
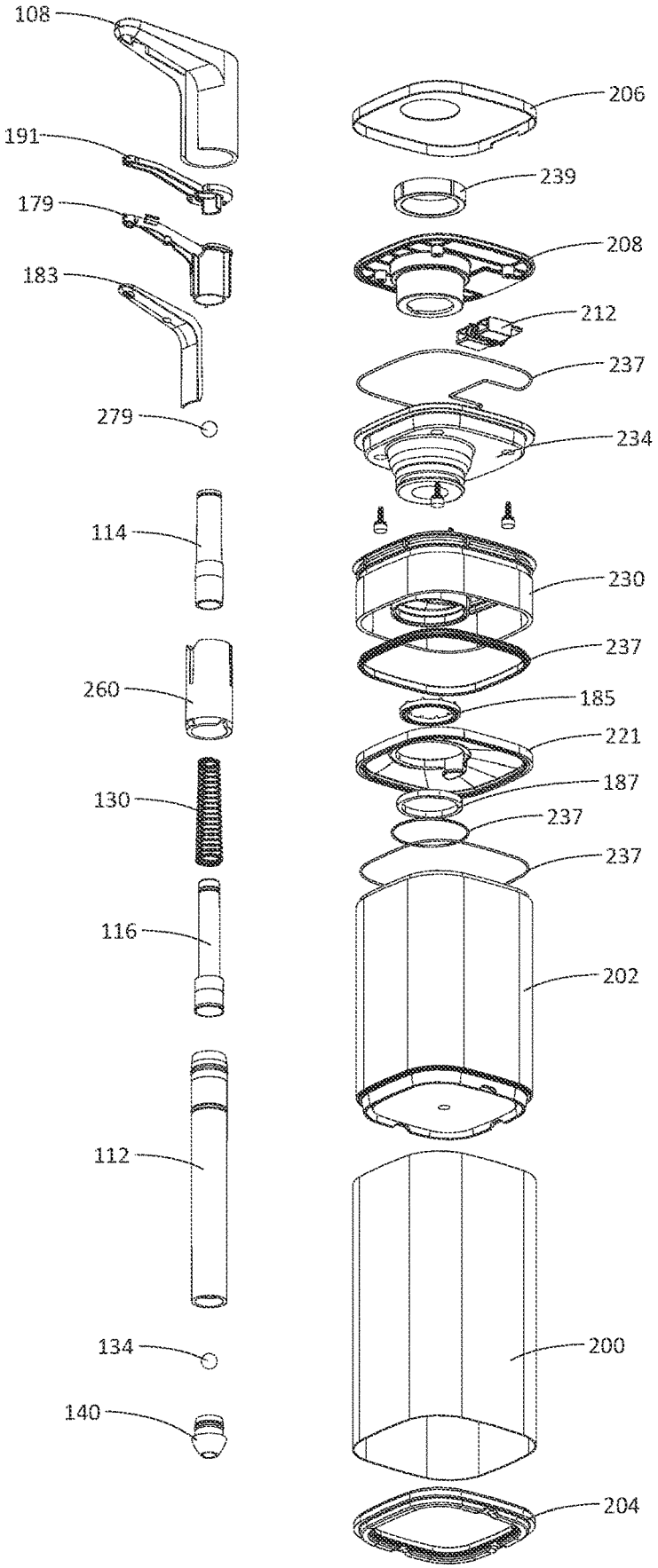
FIG. 13 is a second exploded view of the embodiment of the liquid substance dispenser shown in FIG. 1.

In some embodiments, with reference to FIGS. 8 and 9, the pump sleeve 112 can have a proximal end 112*a* and a distal end 112*b* and can be configured to extend nearly all the way through the space 106 so that the distal end 112*b* of the pump sleeve 112 is positioned adjacent to or proximate to the second end 102*b* of the housing 102, or so that a distal end 112*b* of the pump sleeve 112 is positioned adjacent to or proximate to the second end 106*b* of the space 106.

Some embodiments of the liquid substance dispenser 100 can have a first valve 132. In some embodiments, the first valve 132 can be positioned at or adjacent to the distal end 112*b* of the pump sleeve 112, or at any other position along a length of the pump sleeve 112, such as near the distal end 112*b*, or in a portion of the pump sleeve 112 proximal to the distal end 112*b*. In some embodiments, the first valve 132 can include a spherical ball or other suitably shaped plug 134 that can move (for example, at least axially) within a space 136 within the first valve 132. In some embodiments, a retainer 140 can be coupled with the distal end 112*b* of the pump sleeve 112 and be configured to retain the plug 134 within the space 136. The retainer 140 can be integrally formed with the pump sleeve 112 or as part of the pump sleeve 112, or can be separately formed and coupled with the pump sleeve 112. The retainer 140 can have an opening 142 therein that is in fluid communication with the passageway 118 and the space 106 through which the liquid substance can pass but which is smaller than an outside diameter or size of the plug 134, so that the plug 134 is retained at least in part by the retainer 140 within the space 136. In some embodiments, the retainer 140 can have inwardly tapering or sloping walls to direct the plug 134 toward the opening 142. Though not required, a protrusion or projection 144 can extend toward the plug 134 to limit a range of motion of the plug 134 in an upward or proximal axial direction of the pump sleeve 112.

In operation, the liquid substance dispenser 100 can be configured to cause a portion of the liquid substance 101 to be advanced or dispensed through the passageway 118 of the pump sleeve 112 when the pump head 108 is depressed. With reference to FIGS. 8 and 9, moving the pump head 108 and, consequently, the push rod 110 axially toward the second end portion 106*b* of the space 106 (e.g., in a distal axial or downward direction when the housing is resting on a horizontal surface), such as by depressing the pump head 108 can cause the first valve 132 to close. In the actuated position, the distal end of the push rod 110 can extend distally into the lower half of the inner reservoir of the housing 100, and the distal end of the push rod 110 can have an outer diameter or outer cross-sectional width that is about the same as and/or slightly smaller than the inner diameter or inner cross-sectional width of the distal end of the pump sleeve 112. A positive pressure built up within the passageway 118 of the pump sleeve 112, and/or within other internal passages or spaces within the liquid substance dispenser 100 in fluid communication with the passageway 118 (collectively, herein referred to as the internal passageways 150, which can include the space within the pump sleeve 112 proximal to the first valve 132, the passageway 109 of the pump head 108, the internal passageway 111 of the push rod 110, and other passageways, if any, in fluid communication with the passageway 118 of the pump sleeve 112), can force or bias the plug 134 to move toward the opening 142, thereby causing the space 136 to plug or substantially inhibit flow of the liquid substance 101 through the opening 142. With the valve 132 and the opening 142 substantially or completely closed or at least inhibited, as the pump head 108 is further advanced toward the second end portion 106*b* of the space 106, thereby further reducing a volume of space within the internal passageways 150, any of the liquid substance 101 within the internal passageways 150 can be caused to advance away from the second end portion 106*b* of the space 106 and out through the passageway 109 of the pump head 108 that is in fluid communication with the passageway 118 of the pump sleeve 112.

As the push rod 110 and/or the pump head 108 are relaxed (e.g., when any external force exerted on the pump head 108 are removed, when the pump head 108 and the push rod 110 are in a distal position that is further toward the second end portion 106*b* of the space 106 than when the pump head 108 is in a fully relaxed or proximal position), the spring 130 can bias or force the pump head 108 and the push rod 110 to move away from the second end portion 106*b* of the space 106, thereby causing a suction force or vacuum to be created within the internal passageways 150 proximal to the first valve 132. The suction force or vacuum can draw the plug 134 out of contact with the retainer 140 and the opening 142 so that at least a portion of the liquid substance 101 within the space 106 can be drawn into the internal passageways 150 distal to the first valve 132 by the suction force or vacuum. Any embodiments of the liquid substance dispenser 100 can be configured such that, when the internal passageways 150 are at least partially filled with the liquid substance 101, depressing the pump head 108 will cause the valve 132 to close and the liquid substance 101 to advance through the internal passageways 150 and out through the passageway 109 of the pump head 108, as described above.

In some embodiments, the opening 142 can have a diameter of 6 mm, or approximately 6 mm, or from 4 mm (or approximately 4 mm, or less than 4 mm) to 8 mm (or approximately 8 mm, or more than 8 mm), or of any values within the aforementioned range, or from and to any values with the aforementioned range. Further, in some embodiments, the plug 134 and the plug 174 described below can have a diameter or cross-sectional size of 7 mm, or approximately 7 mm, or from 5 mm (or approximately 5 mm, or less than 5 mm) to 9 mm (or approximately 9 mm, or more than 9 mm), or of any values within the aforementioned range, or from and to any values with the aforementioned range. The size of the plug 134 can be greater than a size or diameter of the opening 142.

In some embodiments, the pump sleeve 112 can be configured to extend toward the second end 102*b* or the second end portion 106*b* of the space 106 such that the distal end 112*b* of the pump sleeve 112 (which can be the distal end of the retainer 140) is within 0.25 in or less, or 0.5 in or less, or from 0.1 in (or approximately 0.1 in) to 0.25 in (or approximately 0.25 in) of the second end portion 106*b* of the space 106. In some embodiments, the pump sleeve 112 can be configured to extend toward the second end 102*b* or the second end portion 106*b* of the space 106 such that the a distance D1 (as shown in FIG. 8) between the distal end 112*b* and the second end portion 106*b* of the space 106 below the distal end 112*b* is less than 5% (or less than approximately 5%) of the distance D2 (as also shown in FIG. 8) from the first end portion 106*a* to the second end portion 106*b* of the space 106, or less than 10% (or less than approximately 10%) of the distance D2 from the first end portion 106*a* to the second end portion 106*b* of the space 106, or from 1% (or approximately 1%, or less than 1%) to 30% (or approximately 30%) of the distance D2, or from 1% (or approximately 1%, or less than 1%) to 15% (or approximately 15%) of the distance D2, or of any of the values within any of the foregoing ranges, or from and to any of the values within any of the foregoing ranges. In some embodiments, the pump sleeve 112 can extend nearly to the bottom of the liquid reservoir inside of the housing 100. For example, in some embodiments, the distance between the distal end of the pump sleeve 112 and the bottom of the liquid reservoir can be less than or equal to about the diameter or cross-sectional width of the pump sleeve 112, or the distance between the distal end 112*b* of the pump sleeve 112 and the bottom of the liquid reservoir can be less than or equal to about the diameter or cross-sectional width of the opening 142 at the distal end 112*b* of the pump sleeve 112. In some embodiments, the distance between a distal end of the pump sleeve and the bottom of the reservoir is less than or equal to about the average diameter or cross-sectional width of a majority of the length of the pump sleeve.

Given that, in some embodiments, the pump sleeve 112 can extend distally to or near the second end portion 106*b* of the space 106, as described herein, some embodiments of the liquid substance dispenser 100 do not need a separately formed dip tube that, in conventional designs, typically extends from the pump sleeve 112 toward the second end portion 106*b* of the space 106 and therefore do not have a separately formed dip tube. This advantageously reduces the number of parts within the liquid substance dispenser 100 and the space 106 and also can result in a larger cross-sectional area within the flow passageway of the internal passageways 150 within the space 106 compared to conventional liquid dispenser devices. For example and without limitation, a dip tube of a conventional liquid or soap dispenser typically has an inner diameter of 1.7-2 mm, making the conventional dispenser with such a dip tube harder to pump as compared to at least some of the embodiments of the liquid substance dispenser 100 disclosed herein that are comparably sized or made for a comparable purpose as compared to the conventional liquid or soap dispenser typically has an inner diameter of 1.7-2 mm. In some embodiments, an inside diameter of the dip tube can be two times greater than a conventional liquid or soap dispenser, and/or can be greater than 6 mm or approximately 6 mm, or from 5 mm or approximately 5 mm to 8 mm or approximately 8 mm, or from 6 mm or approximately 6 mm to 7 mm or approximately 7 mm. The larger cross-sectional area within the flow passageway of the internal passageways 150 and the openings in the pump sleeve 112, for example the opening 142 at the distal end 112*b* of the pump sleeve 112 (which can be 6 mm or approximate 6 mm), as compared to conventional liquid dispenser devices, can result in a lower force required to depress the pump head 108 and dispense the liquid substance 101 in some embodiments.

In some embodiments, with reference to FIG. 8, the liquid substance dispenser 100 can have a second valve 172. In some embodiments, the second valve 172 can be positioned at or adjacent to the first end portion 114*a* of the first push rod portion 114, or within a proximal end portion 114*a* of the first push rod portion 114, or at any other position along a length of the first push rod portion 114. In any embodiments disclosed herein, the second valve 172 can be positioned proximal to the first end portion 114*a*, such as within a space or passage within the pump head 108. In any embodiments, the second valve 172 can include a ball or other suitably shaped plug 174 that can move (for example, at least axially) within a space 176 within the first end portion 114*a* of the first push rod portion 114. The liquid substance dispenser 100 and/or the second valve 172 can be configured to limit an axial movement of the plug 174. For example and without limitation, the first push rod portion 114 can have a restriction 175 in the first end portion 114*a* of the first push rod portion 114 or at any suitable position along a length of the first push rod portion 114, wherein the restriction 175 is configured to prevent the plug 174 from passing therethrough.

In some embodiments, the restriction 175 can have a size or diameter that is less than a size or diameter of the space 176 adjacent to the restriction 175, and that is less than a size or diameter of the plug 174. In some embodiments, the restriction 175 can have a conically shaped tapered surface to guide the plug 174 into alignment with an opening 177 within the restriction 175 and the first push rod portion 114. In this configuration, when the plug 174 is positioned in contact with the opening 177, liquid and/or air within the passageway 109 of the pump head 108 can be prevented or inhibited from advancing past the plug 174 through the opening 177. In some embodiments, the plug 174 can be moved into contact with the opening 177, thereby effectively closing the second valve 172, when the pump head 108 is moving in a second or proximal axial direction (e.g., away from the second end portion 106*b* of the space 106), such as when the pump head 108 is being released. The plug 174 can be moved into contact with the opening, for example and without limitation, due to a vacuum or suction force being created within the portion of the passageway 111 of the push rod 110 that is distal to the plug 174. When the plug 174 is moved out of contact with the restriction 175 and the opening 177, liquid and/or air within the passageway 111 of the push rod 110 can be permitted to advance through the opening 177 past the plug 174 and out through the passageway 109 of the pump head 108. In some embodiments, the plug 174 can be moved out of contact with the restriction 175 and the opening 177, thereby effectively opening the second valve 172, when the pump head 108 is moving in a first or distal axial direction (e.g., toward the second end portion 106*b* of the space 106), such as when the pump head 108 is being depressed.

In this configuration, the second valve 172 can be configured so that releasing the pump head 108 or moving the pump head 108 in the second direction away from the second end portion 106*b* of the space 106 can close the valve 172 and cause a suction force or vacuum to be created within the internal passageways 150 distal to the second valve 172, thereby drawing the liquid substance 101 into the internal passageways 150 distal to the second valve 172. Again, when the pump head 108 is depressed in the first direction toward the second end portion 106*b* of the space 106, at least a portion of the liquid substance 101 within the internal passageways 150 will be caused to advance through the open valve 172 and be dispensed through the passageway 109 of the pump head 108.

Figure 15:
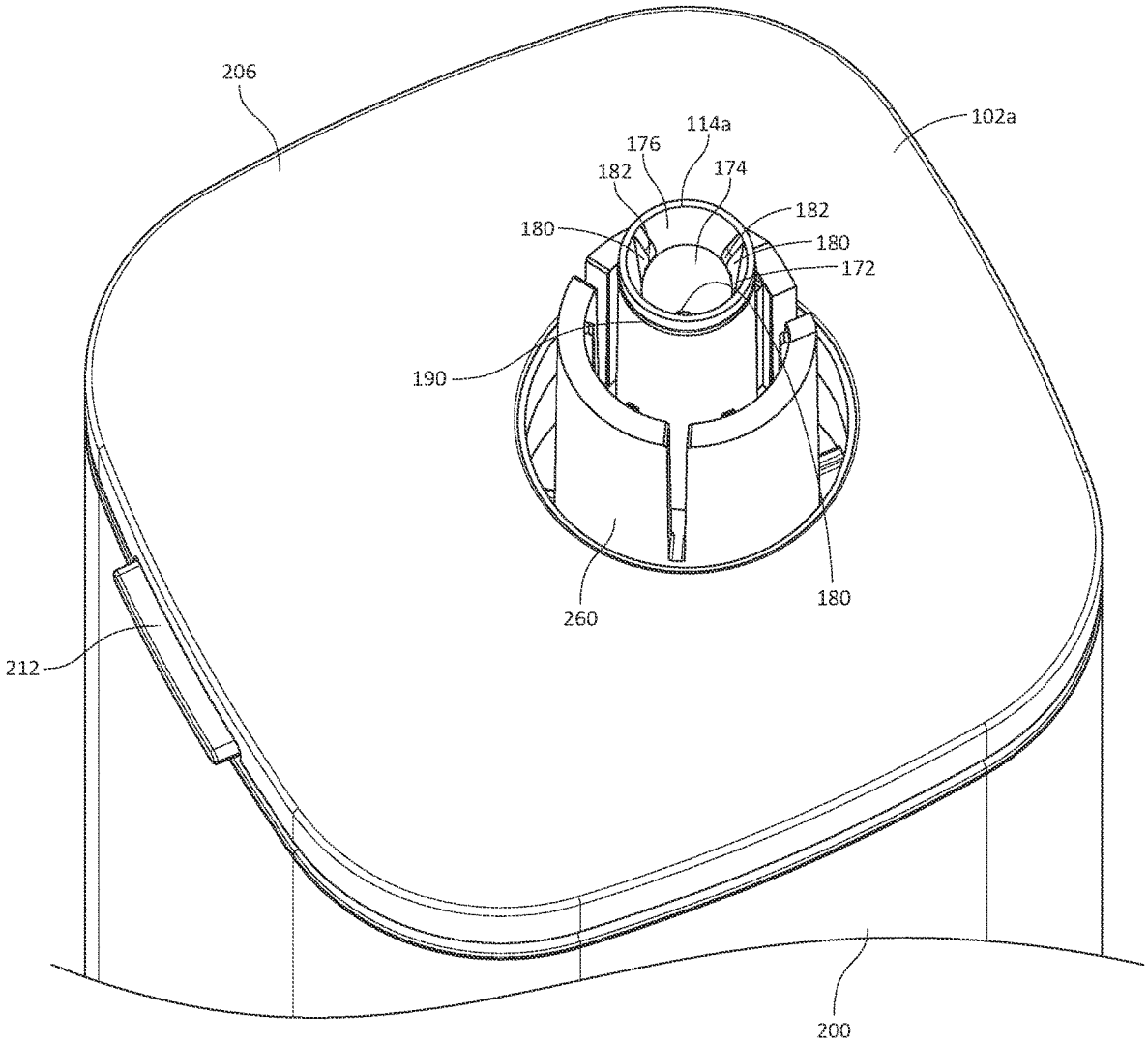
FIG. 15 is a perspective view of the embodiment of the liquid substance dispenser shown in FIG. 1, showing a second valve of the liquid substance dispenser.
Figure 16:
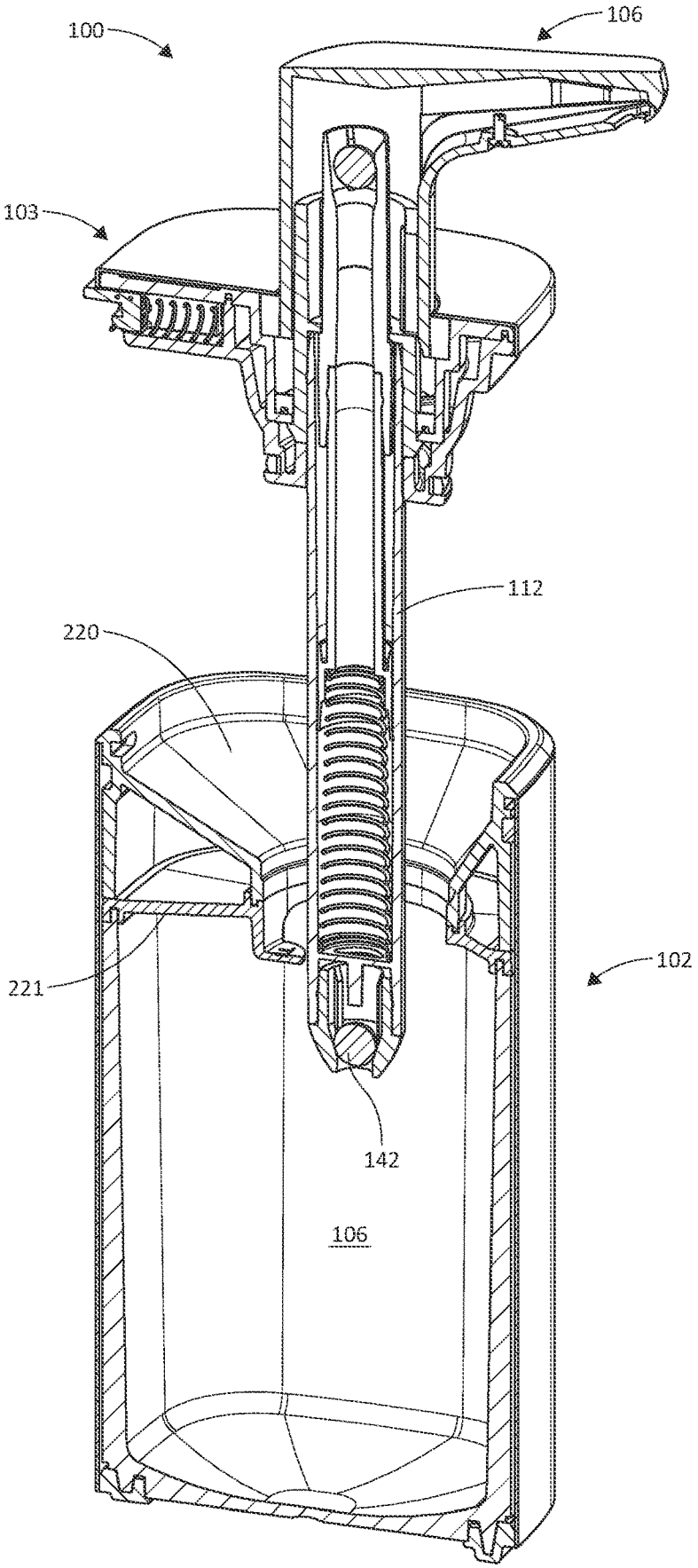
FIG. 16 is a section view of the embodiment of the liquid substance dispenser shown in FIG. 1, showing the liquid substance dispenser in a partially disassembled state wherein at least the pump head and pump sleeve are removed from the housing.

With reference to FIGS. 15 and 16, some embodiments of the second valve 172 can have one or more restrictors 180 (three being shown) that can be configured to prevent an axial movement of the plug 174 in a proximal direction (e.g., away from the second end portion 106*b* of the space 106). The one or more restrictors 180 can extend in an inward radial direction and can have a point or inwardly projecting protrusion 182 that is configured to prevent the plug 174 from moving past the point or protrusion 182 of each of the one or more restrictors 180. In some embodiments, the inwardly projecting protrusions 182 can have an inner diameter that is less than an outer diameter of the plug 174. A radially inwardly facing surface of the one or more restrictors can be smoothly curved. In this configuration, the plug 174 can be permitted to move axially within the space 176 between the one or more restrictors 180 and the restriction 175.

Some embodiments of the liquid substance dispenser 100 can be configured to create a small suction force in the passageway 109 of the pump head 108 when the pump head 108 is released from a position that is distal to the initial or proximal most position of the pump head 108 to draw into the passageway 109 through the opening 179 of the pump head 108 any of the liquid substance 101 that is outside of the opening 179 of the pump head 108 but which still may be in contact with the opening 179 of the pump head 108 (e.g., to draw into the passageway 109 any drips that may still be clinging to the opening 179 of the pump head 108). For example and without limitation, the movement or seating of the plug 174 into sealing contact with the restriction 175 can be delayed (for example, due to the impedance and/or viscosity of the liquid substance 101), thereby causing the aforementioned suction force within at least the passageway 111 of the push rod 110 to also exert a suction force on the passageway 109 within the pump head 108 before the valve 172 is closed that can draw any drips back into the passageway 109 of the pump head 108. In some arrangements, the opening 179 can be formed in a lower component 183 of the pump head.

In some embodiments, the housing 102 can have an outer sleeve member 200 that encloses an inner reservoir for containing liquid, an inner container member 202, an inside of which can provide the space 106, and a bottom end member 204. In some embodiments, the top cover 103 can have an outside surface 103*a* around a perimeter thereof that can have a similar size and shape that aligns with an outside surface 200*a* of the outer sleeve member 200. In any embodiments disclosed herein, the top cover 103 can have a cover portion 206 and an inner body member 208. In some embodiments, the outer sleeve member 200 and the cover portion 206 can be formed from a decorative material, a tile or stone material, a metal such as stainless steel, or otherwise. The inner container member 202 and the inner body member 208 can be made from a molded plastic, a metal material, or any other suitable material.

Figure 2:
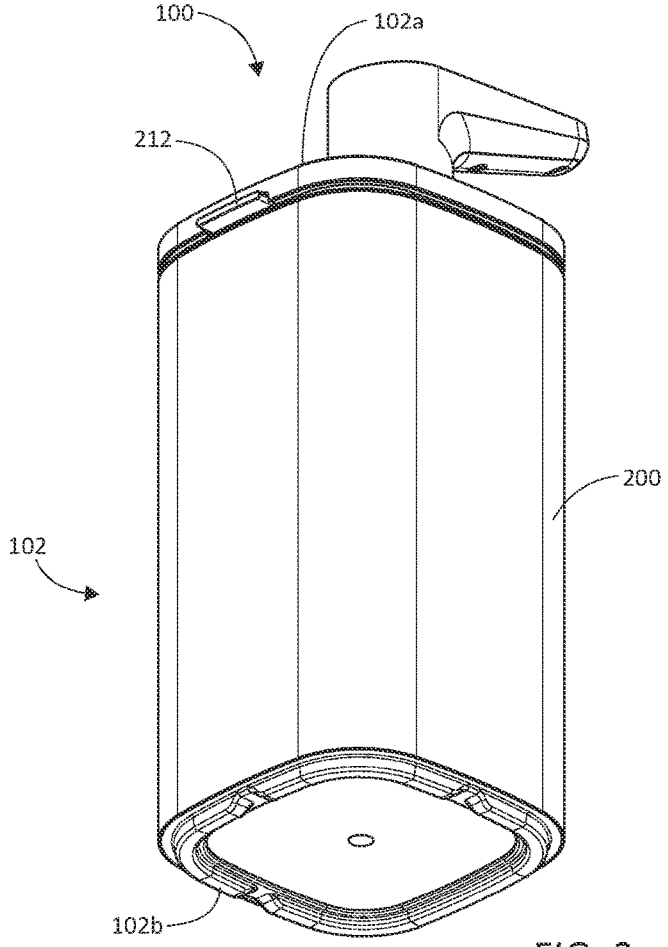
FIG. 2 is a second perspective view of the embodiment of the liquid substance dispenser shown in FIG. 1.
Figure 3:
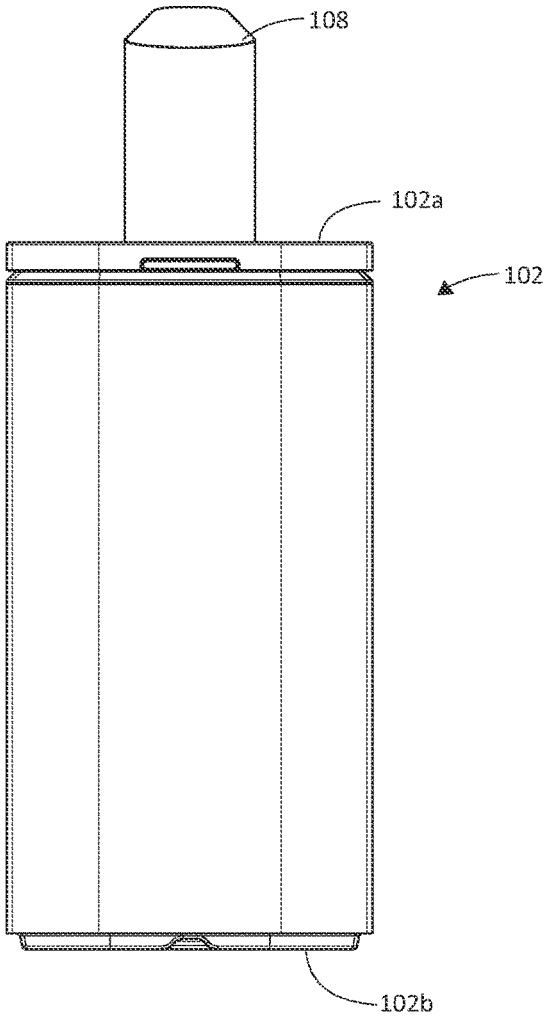
FIG. 3 is a back view of the embodiment of the liquid substance dispenser shown in FIG. 1.
Figure 4:
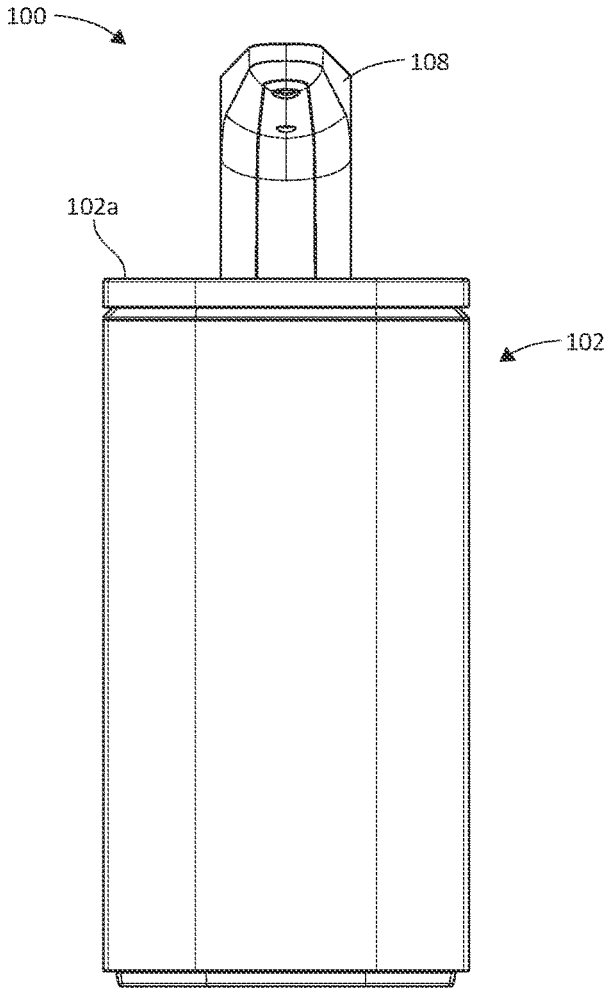
FIG. 4 is a front view of the embodiment of the liquid substance dispenser shown in FIG. 1.
Figure 5:
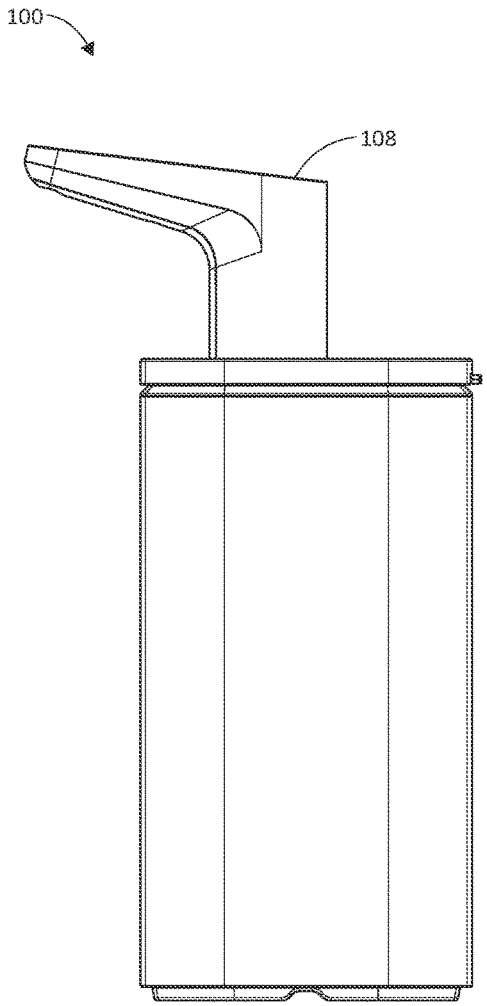
FIG. 5 is a side view of the embodiment of the liquid substance dispenser shown in FIG. 1.
Figure 6:
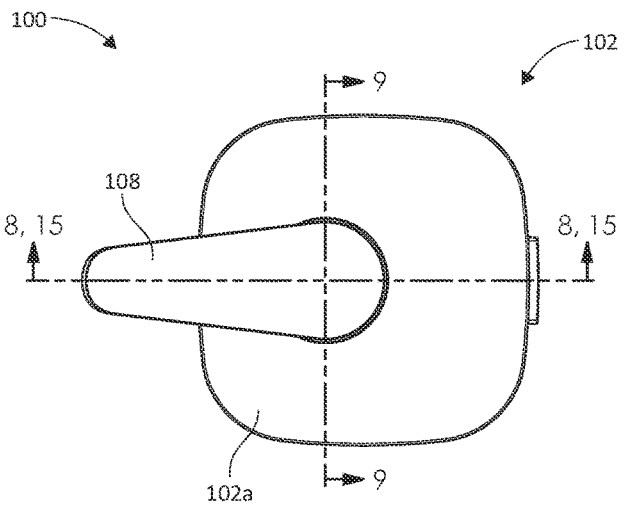
FIG. 6 is a top view of the embodiment of the liquid substance dispenser shown in FIG. 1.
Figure 7:
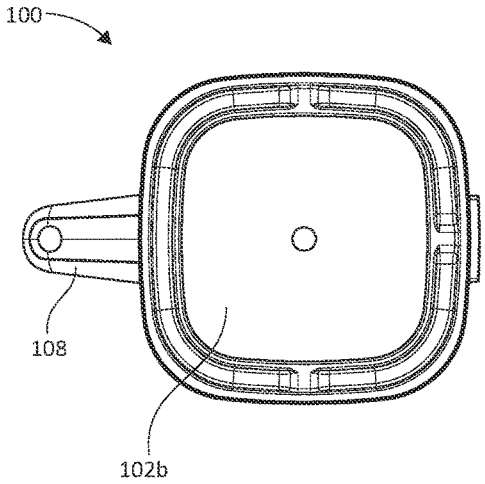
FIG. 7 is a bottom view of the embodiment of the liquid substance dispenser shown in FIG. 1.

Any embodiments of the liquid substance dispenser 100 can be configured to provide an opening into or access to the space 106 within the housing 102 for refilling of the liquid substance 101 within the space 106. For example and without limitation, some embodiments of the liquid substance dispenser 100 can have a movable latch 210 having an actuator 212 (that can be a button or other similar part) that can be moved from a first, latched position (as shown in FIGS. 1, 2, and 8, among others) to a second, unlatched position. The latch 210 can also have a spring or other biasing member 214 configured to bias the actuator 212 toward the first, latched position. The latch 210 can also have a protrusion or latching element 216 configured to selectively engage with a lip or flange 218 of a first inner support member 220. In some embodiments, the latching element 216 can be integrally formed with and protrude away from a body portion of the actuator 212. When the actuator 212 is in the first position, the latching element 216 can extend into a recess 219 formed in the first inner support member 220 so that the flange 218 overlaps or extends over a portion of the latching element 216 and selectively secures the latching element 216 to the first inner support member 220, thereby securing the top cover 103 to the first inner support member 220 and the rest of the housing 102. In some embodiments, the actuator 212 and the biasing member 214 can be supported by a removable support member 234 or positioned within a recess of the removable support member 234. A gasket 236 can provide a seal between the inner body member 208 and the removable support member 234. The first inner support member 220 can be coupled with a second inner support member 221, which can be coupled with a first end portion 202*a* of the inner container member 202. Other gaskets 237 can be used to seal between the various components. A collar 239

Figure 14:
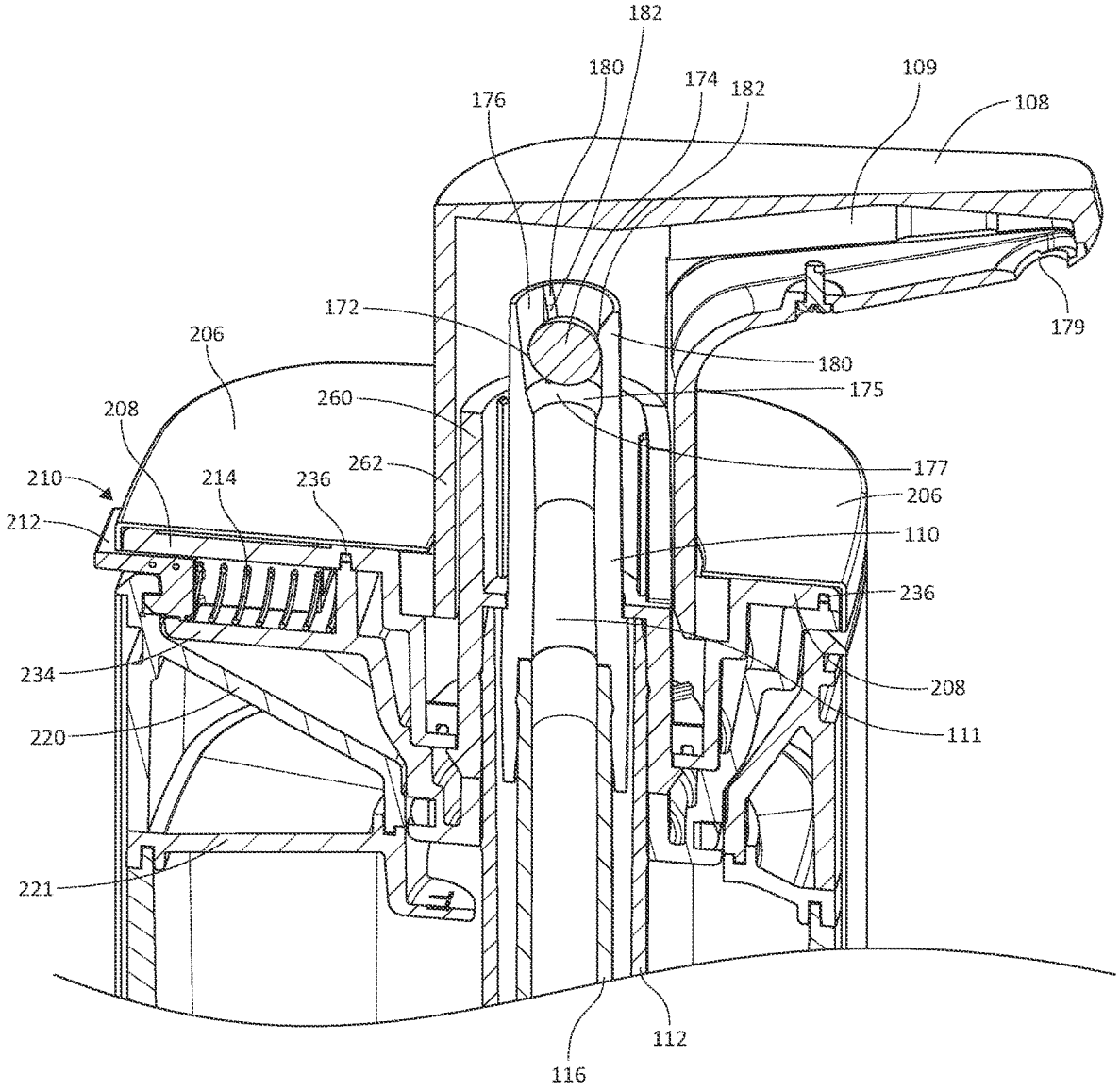
FIG. 14 is a partial section view of the embodiment of the liquid substance dispenser shown in FIG. 1.
Figure 17:
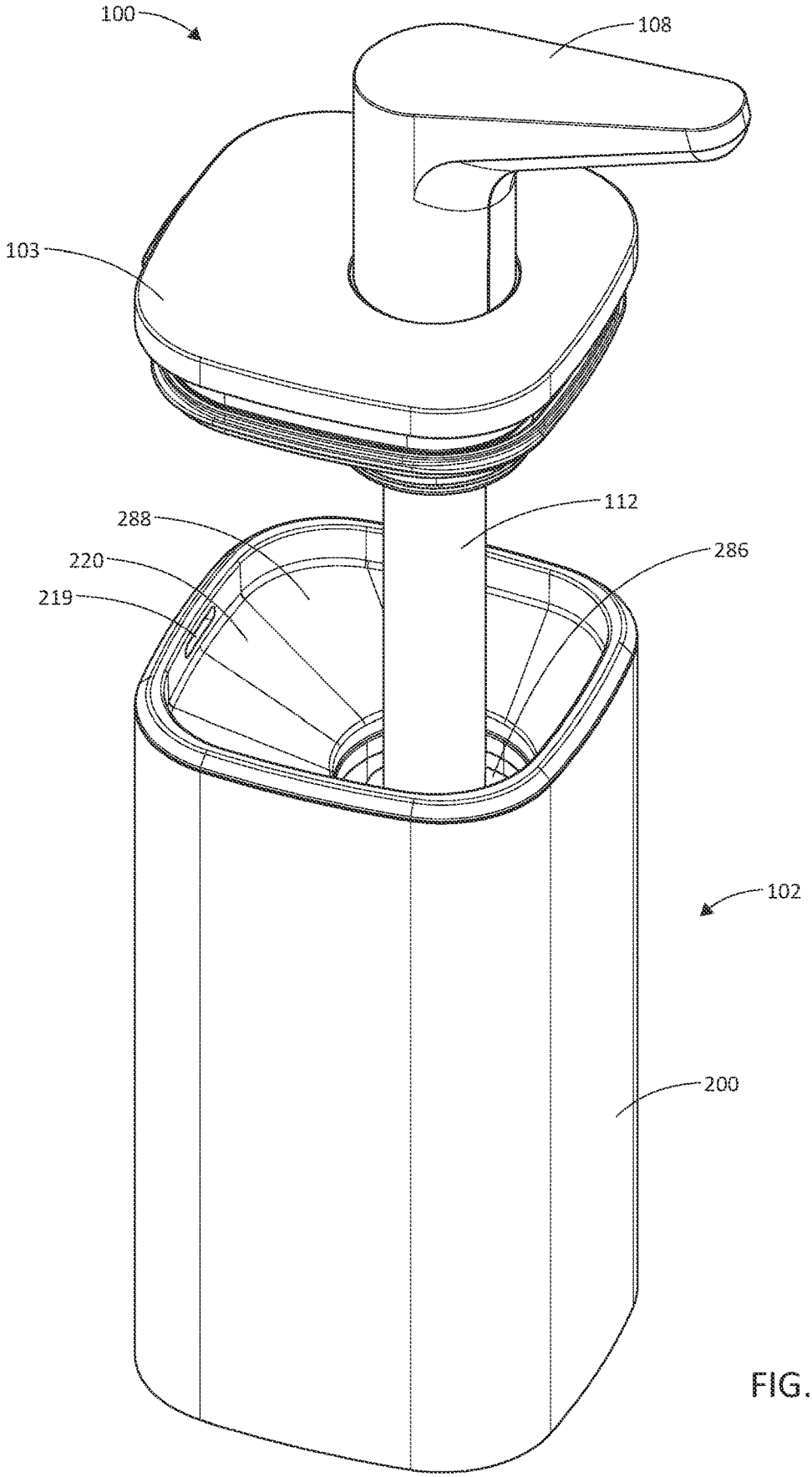
FIG. 17 is a perspective view of the embodiment of the liquid substance dispenser shown in FIG. 1, showing the liquid substance dispenser in a partially disassembled state wherein at least the pump head and pump sleeve are removed from the housing.

In some embodiments, with reference to FIGS. 14 and 15, a collar member 260 can surround an outside surface of the pump sleeve 112 and be configured to fit within an opening or recess 262 in the pump head 108 such that the pump head 108 can be positioned over and around a portion of the collar member 260. In this configuration, by depressing the actuator 212 in a radial inward direction—e.g., to the second, unlatched position, the top cover 103 can be unsecured from the first inner support member 220 and at least the top cover 103 (which can include the cover portion 206 and the inner body member 208), the pump head 108, the push rod 110 (which can include the first push rod portion 114 and the second push rod portion 116), the second valve 172, the latch 210, the removable support member 234, and the collar member 260 can be removed from the housing 102 and/or the rest of the components of the liquid substance dispenser 100, as shown in FIG. 16 and FIG. 17. In this open or partially disassembled state, the space 106 can be filled or refilled with the liquid substance 101 by pouring the liquid substance 101 through the opening 286 in the first inner support member 220. The inwardly and downwardly sloping walls 288 of the first inner support member 220 can facilitate the filling of the space 106.

In some embodiments, the liquid substance dispenser 100 can have additional fasteners, seals, components, and other features such as is shown in the figures or would otherwise be apparent to one of ordinary skill in the art. Further, any components disclosed herein can be made from any suitable material, include plastic (such as, without limitation, polypropylene), any metal, or any other suitable material. In some embodiments, the push rod 110 and the pump sleeve 112 can be made from polypropylene, and certain surfaces or components can have a silicone coating to reduce friction thereof.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims as presented here or as amended in the future or as presented or amended in one or more continuing or divisional applications.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. The ranges disclosed herein also encompass any and all overlap, sub-ranges, and combinations thereof, and any specific values within those ranges. Language such as "up to," "at least," "greater than," "less than," "between," and the like includes the number recited. Numbers and values used herein preceded by a term such as "about" or "approximately" include the recited numbers. For example, "approximately 7 mm" includes "7 mm" and numbers and ranges preceded by a term such as "about" or "approximately" should be interpreted as disclosing numbers and ranges with or without such a term in front of the number or value such that this application supports claiming the numbers, values and ranges disclosed in the specification and/or claims with or without the term such as "about" or "approximately" before such numbers, values or ranges such, for example, that "approximately two times to approximately five times" also includes the disclosure of the range of "two times to five times." The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A manually operated liquid dispenser, comprising:

a housing with a volume of space therein, the volume of space having a first end and a second end;

a pump sleeve extending into the space of the housing and nearly to a bottom, inside surface of the space;

a pump head;

a push rod coupled with the pump head and configured to be axially movable within an axial opening extending through the pump sleeve;

a passageway extending through at least the pump head and the push rod, the passageway being in fluid communication with the axial opening extending through the pump sleeve and with the volume of space within the housing;

a first valve configured to control a passage of a liquid substance within the volume of space in the housing through a passageway, the first valve comprising a first plug configured to be axially movable within a space within the first valve;

a second valve configured to control a passage of a liquid substance within the volume of space in the housing through a passageway in the pump head, the second valve comprising a second plug configured to be axially movable within a space within the second valve; and an inner support member having one or more inwardly and downwardly sloping walls configured to facilitate filling the volume of space with the liquid substance;

wherein the second valve is located in a space within the pump head.

2. The dispenser of claim 1, wherein the dispenser does not have a dip tube.

3. The dispenser of claim 1, wherein the dispenser is configured to fully depress and dispense a liquid substance with 1 kg or less of force applied to the pump head.

4. The dispenser of claim 1, wherein the pump sleeve extends toward the second end of the volume of space such that a distance between a distal end of the pump sleeve and the second end of the volume of space is less than approximately 5% of the distance from the first end of the volume of space of the housing to the second end of the volume of space of the housing.

5. The dispenser of claim 1, wherein the pump sleeve extends toward the second end of the volume of space such that a distance between a distal end of the pump sleeve and the second end of the volume of space is less than or equal to an average diameter or cross-sectional width of a majority of a length of the pump sleeve.

6. The dispenser of claim 1, comprising a spring configured to axially bias the push rod toward the pump head.

7. The dispenser of claim 1, wherein the first valve is configured to close or inhibit a flow of liquid through the first valve when the pump head is depressed.

8. The dispenser of claim 1, wherein the first valve is positioned at a distal end of the pump sleeve and the second valve is positioned at a proximal end of the pump sleeve.

9. The dispenser of claim 1, wherein the second valve is configured to prevent a passage of air past the second valve when the pump head is returning from a depressed position to an undepressed position.

10. The dispenser of claim 1, wherein a suction force or vacuum moves the first plug axially within the space within the first valve to allow the liquid substance to be drawn into the passageway.

11. The dispenser of claim 1, further comprising a retainer in fluid communication with the axial opening extending through the pump sleeve, wherein the retainer retains the first plug within the space within the first valve.

12. The dispenser of claim 11, wherein the retainer comprises an opening in fluid communication with the axial opening, the opening of the retainer having a smaller diameter or cross-sectional width than a diameter the first plug.

13. The dispenser of claim 11, wherein the retainer comprises an opening in fluid communication with the axial opening, wherein the opening of the retainer has a smaller average diameter or cross-sectional width than an average diameter or cross-sectional width of a majority of a length of the pump sleeve.

14. The dispenser of claim 1, wherein the second valve comprises one or more restrictors configured to prevent an axial movement of the second plug in a proximal direction.

15. The dispenser of claim 14, wherein the one or more restrictors extend in a radial direction and comprise an inwardly projecting protrusion, the inwardly projecting protrusion is configured to prevent the second plug from moving past the inwardly projecting protrusion.

16. The dispenser of claim 1, further comprising a projection, wherein the projection extends towards the first plug to limit a range of motion of the first plug in a proximal axial direction of the pump sleeve.

17. The dispenser of claim 1, wherein in a fully actuated position, a distal end of the push rod extends into a lower half of the space of the housing.

18. The dispenser of claim 1, comprising a spring tapered from a first end portion of the spring to a second end portion of the spring, the first end portion of the spring has a smaller diameter of the second end portion of the spring.

19. A manually operated liquid dispenser, comprising:

a housing with a volume of space therein, the volume of space having a first end and a second end;

a pump sleeve extending into the space of the housing;

a pump head;

a push rod coupled with the pump head and configured to be axially movable within an axial opening extending through the pump sleeve;

a passageway extending through at least the pump head and the push rod, the passageway being in fluid communication with the axial opening extending through the pump sleeve and with the volume of space within the housing;

a first valve configured to control a passage of a liquid substance within the volume of space in the housing through a passageway, the first valve comprising a first plug configured to be axially movable within a space within the first valve;

a second valve configured to control a passage of a liquid substance within the volume of space in the housing through a passageway, the second valve comprising a second plug configured to be axially movable within a space within the second valve; and an inner support member having one or more inwardly and downwardly sloping walls configured to facilitate filling the volume of space with the liquid substance;

wherein the first valve is positioned at a distal end of the pump sleeve and the second valve is positioned at a proximal end of the pump sleeve;

wherein the first valve and second valve independently control the passage of the liquid substance within the volume of space in the housing.

20. The dispenser of claim 19, wherein the first valve is configured to close or inhibit a flow of liquid through the first valve when the pump head is depressed.

21. The dispenser of claim 19, wherein the second valve is configured to prevent a passage of air past the second valve when the pump head is returning from a depressed position to an undepressed position.

22. The dispenser of claim 19, further comprising a projection, wherein the projection extends towards the first plug to limit a range of motion of the first plug in a proximal axial direction of the pump sleeve.

23. The dispenser of claim 19, wherein the push rod has a substantially cylindrical first push rod portion and a second push rod portion, the second push rod portion coupled with and axially aligned with the first push rod portion.

24. The dispenser of claim 23, wherein a proximal end portion of the first push rod portion includes the second plug, wherein the second plug is configured to move with the proximal end portion.

25. The dispenser of claim 19, further comprising a retainer in fluid communication with the axial opening extending through the pump sleeve, the retainer having an opening with an inner diameter at a distal end thereof about the same as an inner diameter of the push rod or a width of an internal passageway through the push rod.

26. A manually operated liquid dispenser, comprising:

a housing with a liquid reservoir configured to contain liquid, the liquid reservoir comprising a top and a bottom, and an upper half and a lower half;

a pump sleeve extending into the liquid reservoir of the housing such that a distance between a distal end of the pump sleeve and the bottom of the reservoir is less than or equal to about an average diameter or cross-sectional width of a majority of a length of the pump sleeve, the pump sleeve having an inner diameter or cross-sectional width;

a pump head;

a push rod coupled with the pump head and configured to be axially movable within an axial opening extending through the pump sleeve, the push rod comprising a distal end with an outer diameter or cross-sectional width that is about a same size as the inner diameter or cross-sectional width of the pump sleeve;

a passageway extending through at least the pump head and the push rod, the passageway being in fluid communication with the axial opening extending through the pump sleeve and with a volume of space within the housing;

a first valve configured to control a passage of a liquid substance within the volume of space in the housing through a passageway, the first valve comprising a first plug configured to be axially movable within a space within the first valve; and an inner support member having one or more inwardly and downwardly sloping walls configured to facilitate filling the volume of space with the liquid substance;

wherein the dispenser is configured to dispense a viscous substance;

wherein the dispenser is configured to fully depress and dispense the viscous substance with about 1 kg or less of force applied to the pump head;

wherein in a fully actuated position, the distal end of the push rod extends into the lower half of the liquid reservoir.

27. The dispenser of claim 26, wherein the viscous substance is a lotion or a liquid soap.

28. The dispenser of claim 26, wherein the dispenser is configured to fully depress and dispense a liquid substance with 1 kg or less of force applied to the pump head.

29. The dispenser of claim 26, wherein the distal end of the push rod comprises one or more walls configured to at least partially surround a tapered first end portion of a spring.

* * * * *